US010674261B2

(12) United States Patent
Nakadai et al.

(10) Patent No.: US 10,674,261 B2
(45) Date of Patent: Jun. 2, 2020

(54) TRANSFER FUNCTION GENERATION APPARATUS, TRANSFER FUNCTION GENERATION METHOD, AND PROGRAM

(71) Applicant: HONDA MOTOR CO., LTD., Tokyo (JP)

(72) Inventors: Kazuhiro Nakadai, Wako (JP); Hirofumi Nakajima, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/542,375

(22) Filed: Aug. 16, 2019

(65) Prior Publication Data

US 2020/0077185 A1 Mar. 5, 2020

(30) Foreign Application Priority Data

Aug. 31, 2018 (JP) ..... 2018-163049

(51) Int. Cl.
*H04R 3/00* (2006.01)
*H04R 29/00* (2006.01)
*H04R 1/40* (2006.01)

(52) U.S. Cl.
CPC ..... *H04R 3/005* (2013.01); *H04R 1/406* (2013.01); *H04R 29/005* (2013.01)

(58) Field of Classification Search
CPC ..... H04R 3/005; H04R 1/406; H04R 29/005
See application file for complete search history.

(56) References Cited

U.S. PATENT DOCUMENTS

2008/0140396 A1* 6/2008 Grosse-Schulte ..... G10L 15/20 704/227
2013/0294608 A1* 11/2013 Yoo ..... G10L 21/0272 381/56
2013/0294611 A1* 11/2013 Yoo ..... G10L 21/028 381/66
2018/0041849 A1* 2/2018 Farmani ..... H04R 25/552
2019/0394564 A1* 12/2019 Mehra ..... H04R 1/406

FOREIGN PATENT DOCUMENTS

JP 2010-171785 8/2010

* cited by examiner

*Primary Examiner* — Simon King
(74) *Attorney, Agent, or Firm* — Rankin, Hill & Clark LLP

(57) ABSTRACT

A transfer function generation apparatus includes: a modeling part that models, using a function which uses an arrival direction of a sound source as a non-discrete argument, a plurality of acoustic transfer functions to a microphone from sound sources present in a plurality of directions and that stores the modeled function; and a transfer function generation part that generates a transfer function of an arbitrary direction by using the modeled and stored function.

15 Claims, 27 Drawing Sheets

TRANSFER FUNCTION GENERATION APPARATUS, TRANSFER FUNCTION GENERATION METHOD, AND PROGRAM

CROSS-REFERENCE TO RELATED APPLICATION

Priority is claimed on Japanese Patent Application No. 2018-163049, filed on Aug. 31, 2018, the contents of which are incorporated herein by reference.

BACKGROUND

Field of the Invention

The present invention relates to a transfer function generation apparatus, a transfer function generation method, and a program.

BACKGROUND

In speech recognition, for example, an acoustic signal is collected by a microphone array that is formed of a plurality of microphones, and sound source localization or sound source separation is performed with respect to the collected acoustic signal. The sound source localization is a process in which a sound source position is estimated. The sound source separation is a process in which a signal of each sound source is extracted from a plurality of sound sources. In speech recognition, a feature quantity is extracted from data obtained by the sound source localization and data obtained by the sound source separation, and the speech recognition is performed on the basis of the extracted feature quantity. A transfer function to each microphone of the microphone array is used in the sound source localization and the sound source separation. The transfer function is calculated by collecting a measurement signal that is output from the sound source using the microphone and obtaining an impulse response from the collected measurement signal. It is possible to obtain the impulse response by outputting an impulse from the sound source and collecting the output impulse.

Regarding the transfer function, two generation methods are known, namely, a theory-based method and an actual measurement-based method. The theory-based method is a method in which the transfer function is obtained by calculation from a theoretical formula of sound propagation. The actual measurement-based method is a method in which a speaker is provided at a sound source position, an impulse response is measured by transmitting a measurement signal such as a TSP (Time-Stretched-Pulse; frequency sweep pattern) signal, and the transfer function is obtained by performing Fourier transform of the impulse response.

The actual measurement-based transfer function is more accurate than the theory-based transfer function. This is because the actual measurement-based transfer function includes all of the influences of actual sound propagation such as the characteristics of the microphone and diffraction by a tool. In order to generate a database (hereinafter, also referred to as a TFDB) in which a transfer function to a plurality of microphones from sound sources in various directions on the actual measurement basis is recorded, a very large amount of time and effort are required. This is because a large number of transfer functions are required. For example, in order to perform the sound source localization with an accuracy of 5° for both the azimuth angle and the elevation angle, a TFDB that includes transfer functions in 2522 (=72×35+2) directions is required. Further, in order to perform the sound source localization with an accuracy of 1° for both the azimuth angle and the elevation angle, transfer functions in 64442 (=360×179+2) directions are required.

For example, Japanese Unexamined Patent Application, First Publication No. 2010-171785 discloses a method in which a transfer function in an intermediate direction is obtained by interpolation from a small number of transfer functions in a limited direction. By using this technique, it is possible to obtain a transfer function of a fine angle without measuring a large number of transfer functions.

SUMMARY

However, according to the technique disclosed in Japanese Unexamined Patent Application, First Publication No. 2010-171785, the originally measured transfer function is limited to an angle obtained by equally dividing the entire circumference with an integer. Further, according to the technique disclosed in Japanese Unexamined Patent Application, First Publication No. 2010-171785, the angle of the transfer function that can be calculated by interpolation is also required to be an integral multiple of the actually measured angle interval. Therefore, according to the technique disclosed in Japanese Unexamined Patent Application, First Publication No. 2010-171785, it is impossible to obtain a transfer function value of an arbitrary intermediate angle by interpolation.

An aspect of the present invention provides a transfer function generation apparatus, a transfer function generation method, and a program capable of obtaining a transfer function of an arbitrary angle.

(1) A transfer function generation apparatus according to an aspect of the present invention includes: a modeling part that models, using a function which uses an arrival direction of a sound source as a non-discrete argument, a plurality of acoustic transfer functions to a microphone from sound sources present in a plurality of directions and that stores the modeled function; and a transfer function generation part that generates a transfer function of an arbitrary direction by using the modeled and stored function.

(2) In the above transfer function generation apparatus, in the modeling of the transfer function, the modeling part may use a transfer function from the sound source to a reference microphone among a plurality of microphones as a reference transfer function, may generate a transfer function that represents an amplitude ratio and a phase difference relative to the reference transfer function as a relative transfer function by dividing a transfer function to a different target microphone than the reference microphone among the plurality of microphones by the reference transfer function, and may store the relative transfer function as the modeled function.

(3) In the above transfer function generation apparatus, the modeling part may formulate the modeling of the transfer function by Fourier series expansion of one dimension or two or more dimensions using one arrival direction or two or more arrival directions as a main argument.

(4) In the above transfer function generation apparatus, the modeling part may obtain, as a coefficient of the modeling by the Fourier series expansion, the coefficient by which a sum of squares of a modeling error becomes minimum, and a square norm of the coefficient of the modeling becomes minimum.

(5) In the above transfer function generation apparatus, the modeling part may obtain the coefficient of the modeling by using a Moore-Penrose pseudo-inverse matrix from transfer functions from arbitrary two or more directions.

(6) In the above transfer function generation apparatus, intervals of arrival angles of a plurality of acoustic transfer functions to one or more microphones from the sound sources present in the plurality of directions may not be equal to each other.

(7) A transfer function generation method according to another aspect of the present invention includes: by way of a modeling part, modeling, using a function which uses an arrival direction of a sound source as a non-discrete argument, a plurality of acoustic transfer functions to a microphone from sound sources present in a plurality of directions and storing the modeled function; and by way of a transfer function generation part, generating a transfer function of an arbitrary direction by using the modeled and stored function.

(8) Another aspect of the present invention is a computer-readable non-transitory recording medium which includes a program that causes a computer of a transfer function generation apparatus to execute: modeling, using a function which uses an arrival direction of a sound source as a non-discrete argument, a plurality of acoustic transfer functions to a microphone from sound sources present in a plurality of directions and storing the modeled function; and generating a transfer function of an arbitrary direction by using the modeled and stored function.

According to (1), (7), or (8) described above, it is possible to obtain a transfer function of an arbitrary angle in addition to an intermediate value of an actual measurement value.

According to (2) described above, without performing a measurement in advance, it is possible to build a database of a transfer function from an acoustic signal that is obtained in a process in which the transfer function generation apparatus is used.

According to (3) described above, by using Fourier series expansion, it is possible to represent the periodicity in an angle direction as is, and therefore, it is possible to formulate an approximation model with high accuracy compared to a conventional linear interpolation using two points or more and the like. According to (3) described above, differently from the linear interpolation, the estimation accuracy is not easily degraded even at a position where the interval between data is wide.

According to (4) described above, equally spaced data having the same number of points as the number of Fourier coefficients are not required, and the number of points of data may be small or large. Further, it is possible to obtain a coefficient even when the data are not equally spaced.

According to (5) described above, since a pseudo-inverse matrix is used, the number of points of data may be small or large, and further, it is possible to obtain a coefficient even when the data are not equally spaced.

According to (6) described above, when measuring a transfer function required for the modeling, even when the arrival angles of the sound sources are not equally spaced, it is possible to obtain a transfer function of an arbitrary angle in addition to an intermediate value of an actual measurement value.

DESCRIPTION OF THE EMBODIMENTS

Figure 1:
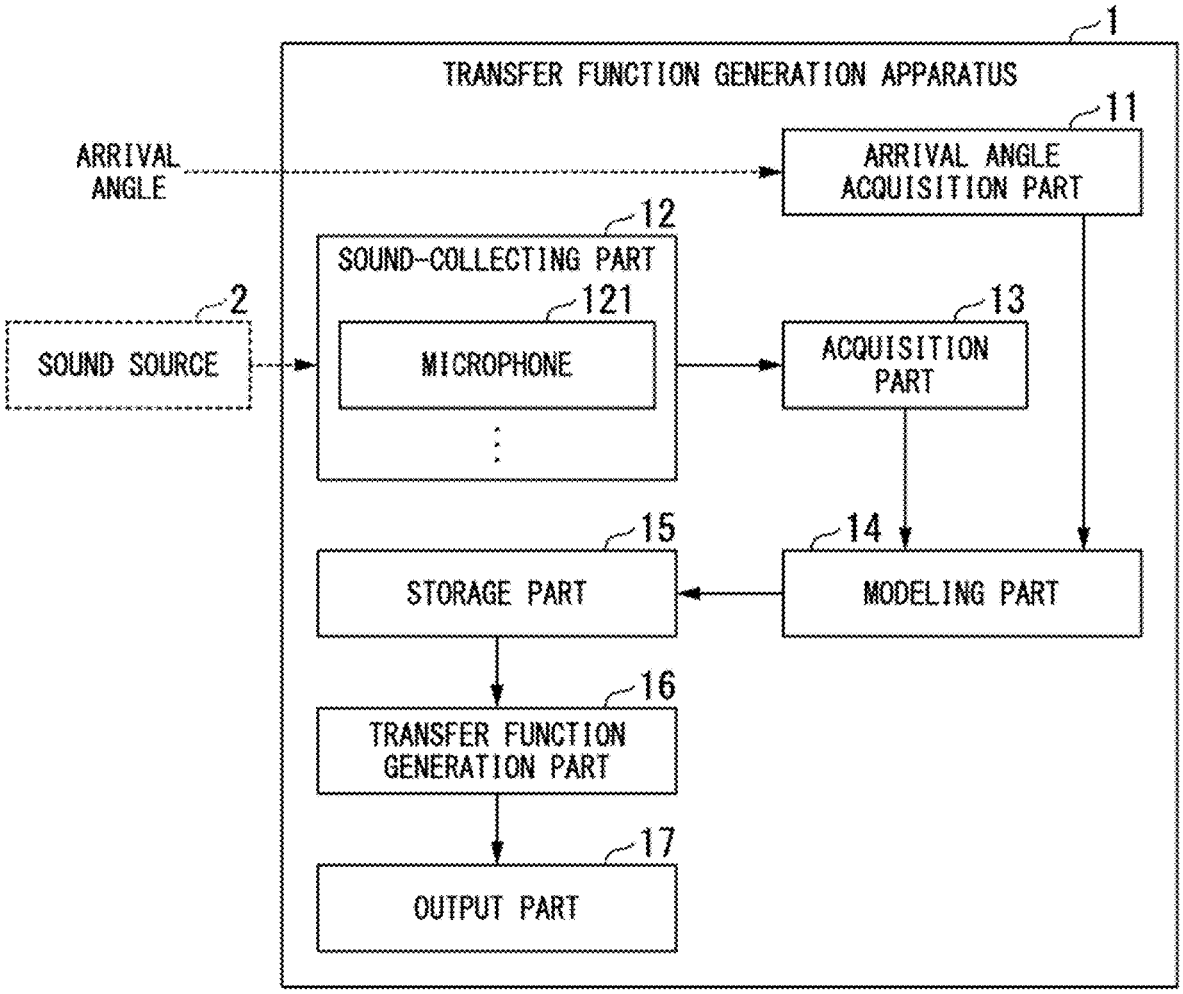
FIG. 1 is a block diagram showing a configuration example of a transfer function generation apparatus according to an embodiment.

Hereinafter, embodiments of the present invention will be described with reference to the drawings. In the drawings used for the following description, the scales of members are appropriately changed so that each member has a recognizable size.

FIG. 1 is a block diagram showing a configuration example of a transfer function generation apparatus 1 according to the present embodiment. As shown in FIG. 1, the transfer function generation apparatus 1 includes an arrival angle acquisition part 11, a sound-collecting part 12, an acquisition part 13, a modeling part 14, a storage part 15, a transfer function generation part 16, and an output part 17.

A sound source 2 is, for example, a speaker. The sound source 2 emits a predetermined measurement signal.

The arrival angle acquisition part 11 acquires an arrival angle that is an angle of the sound source 2 with respect to the sound-collecting part 12. A user may input the arrival angle. The arrival angle acquisition part 11 outputs the acquired arrival angle to the modeling part 14. The arrival angle includes an azimuth angle θ and an elevation angle ϕ on a horizontal plane, and each of the azimuth angle and the elevation angle includes a plurality of angles.

The sound-collecting part 12 is a microphone array that is formed of one microphone 121 or a plurality of microphones (121, 122 . . . (refer to FIG. 2)). The sound-collecting part 12 collects an acoustic signal that is emitted by the sound source 2 and outputs the collected acoustic signal to the acquisition part 13.

The acquisition part 13 acquires an analog acoustic signal that is output by the sound-collecting part 12 and converts the acquired analog acoustic signal into a digital acoustic signal. Sampling of a plurality of acoustic signals each of which is output by each of the plurality of microphones of the sound-collecting part 12 is performed by using a signal having the same sampling frequency. The acquisition part 13 outputs the acoustic signal that is converted into the digital signal to the modeling part 14.

The modeling part 14 uses the arrival angle that is output by the arrival angle acquisition part 11 and the acoustic signal that is output by the acquisition part 13 and that is converted into the digital signal and models a transfer function by representing the transfer function as a function which uses an arrival direction as an argument. That is, the modeling part 14 does not record by discretized arrival directions of a plurality of sound sources as in the related art. The modeling part 14 stores the modeled transfer function in the storage part 15. A process that is performed by the modeling part 14 is described later.

The storage part 15 is a database of a transfer function. The storage part 15 stores the transfer function that is modeled and represented as the function which uses the arrival direction as the argument with respect to each of the microphones that are included in the sound-collecting part 12. In information that is stored by the storage part 15, a coefficient described later is stored with respect to each of the microphones.

The transfer function generation part 16 generates a transfer function of an arbitrary arrival angle by using the transfer function that is modeled and stored by the storage part 15 and outputs the generated transfer function to the output part 17.

The output part 17 outputs the transfer function that is output by the transfer function generation part 16 to an external apparatus. The external apparatus includes, for example, a speech recognition apparatus, a sound source separation apparatus, a sound source identification apparatus, and the like.

[One-Dimensional Modeling]

Next, one-dimensional modeling is described.

Figure 2:
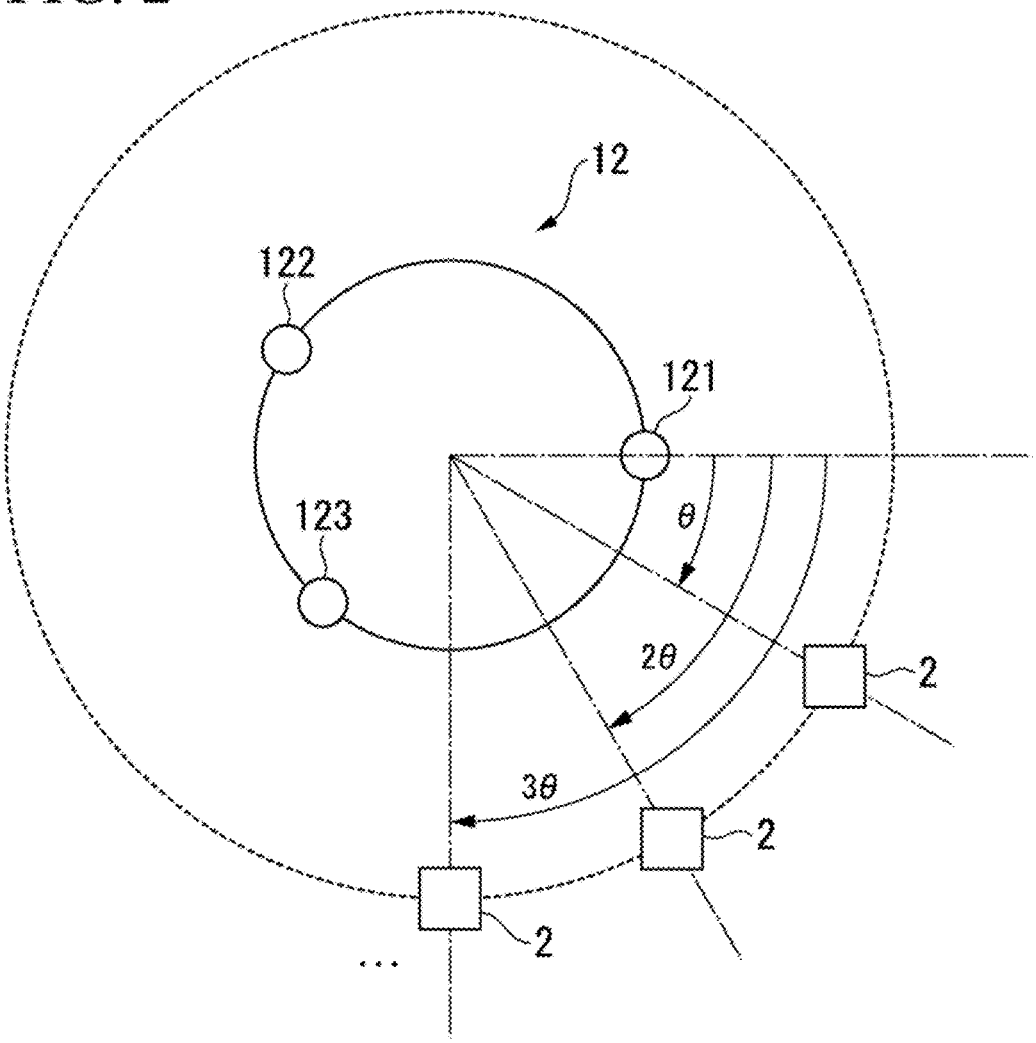
FIG. 2 is a view showing an azimuth angle θ in two dimensions.

FIG. 2 is a view showing an azimuth angle (arrival angle) θ in two dimensions (space). In an example shown in FIG. 2, the sound-collecting part 12 includes three microphones (121, 122, and 123). When generating a model, a user of the transfer function generation apparatus 1 moves the sound source 2 that emits a measurement signal at an angle interval of θ and inputs azimuth angles θ, 2θ, 3θ . . . to the transfer function generation apparatus 1. The θ is, for example, 15 degrees, 30 degrees, and the like.

As shown in FIG. 2, when it is assumed that only the azimuth angle θ, which is the arrival direction on a horizontal plane, is a variable number, it is possible to model an amplitude |H(θ, ω) | of the transfer function using Expression (1), and it is possible to model a phase ∠(θ, ω) using Expression (2).

$$|H(\theta,\omega)| = A_0(\omega) + A_1(\omega)\cos(\theta) + B_1\sin(\theta) + A_2(\omega)\cos(2\theta) + B_2\sin(2\theta) + \ldots + A_N(\omega)\cos(N\theta) + B_N\sin(N\theta) = A_0(\omega) + \sum_{n=1}^{N}(A_n(\omega)\cos(n\theta) + B_n(\omega)\sin(n\theta)) \quad (1)$$

$$\angle H(\theta,\omega) = A'_0(\omega) + \sum_{n=1}^{N}(A'_n(\omega)\cos(n\theta) + B'_n(\omega)\sin(n\theta)) \quad (2)$$

In Expression (1) and Expression (2), ω is an angular frequency, N is a modeling order in a horizontal direction, and n is a variable number. Further, A and B are coefficients with respect to the amplitude, and A' and B' are coefficients with respect to the phase. In this way, the present model is a model in which the Fourier coefficient with respect to the azimuth angle θ as the arrival direction is stored at each frequency ω.

The modeling of Expression (1) and Expression (2) can also be represented by using a complex Fourier coefficient as Expression (3) and Expression (4).

$$|H(\theta,\omega)|=\Sigma_{n=-N}^{N}C_n(\omega)\exp(in\theta) \quad (3)$$

$$\angle H(\theta,\omega)=\Sigma_{n=-N}^{N}C'_n(\omega)\exp(in\theta) \quad (4)$$

In Expression (3) and Expression (4), C and C' are coefficients, and i is a complex number. The modeled function is a real number, and therefore, in Expression (3) and Expression (4), relationships of Expression (5) and Expression (6) are satisfied.

$$C_n(-\omega)=C_n^*(\omega) \quad (5)$$

$$C'_n(-\omega)=C'^*_n(\omega) \quad (6)$$

In Expression (5) and Expression (6), * represents a complex conjugate.

Further, it is possible to model a transfer function without separating the amplitude and the phase as a complex amplitude that unites the phase and the amplitude like Expression (7).

$$H(\theta,\omega)=\Sigma_{n=-N}^{N}C''_n(\omega)\exp(in\theta) \quad (7)$$

In Expression (7), $C''_n(\omega)$ is a complex function, and in general, $C''_n(-\omega)\neq C''^*_n(\omega)$.

(Expression (1) and Expression (2)) and (Expression (3) and Expression (4)) described above are mathematically equivalent to each other. (Expression (3) and Expression (4)) and Expression (7) are also equivalent to each other when N is sufficiently large but are not equivalent to each other when N is small.

[Two-Dimensional Modeling]

Next, two-dimensional modeling is described.

Figure 3:
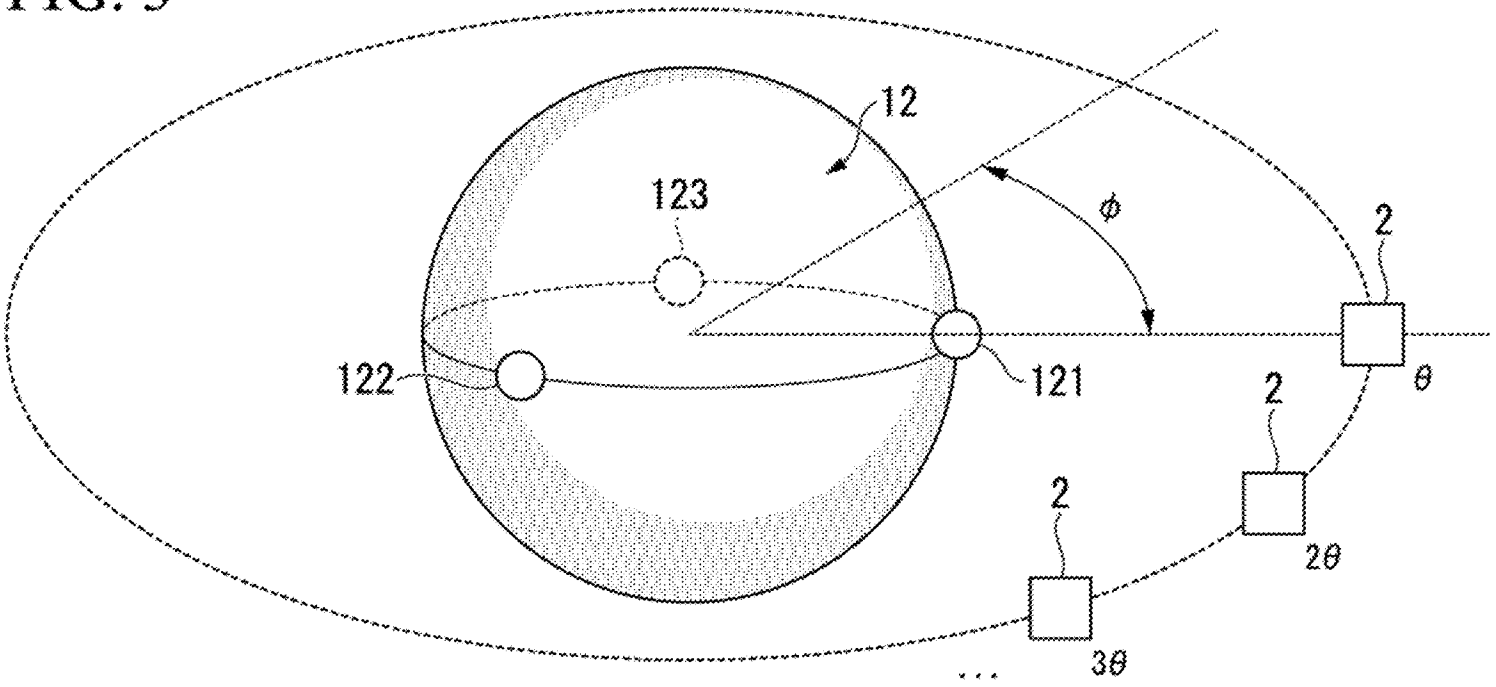
FIG. 3 is a view showing an azimuth angle θ and an elevation angle ϕ).

FIG. 3 is a view showing an azimuth angle θ and an elevation angle ϕ. In an example shown in FIG. 3, the sound-collecting part 12 includes three microphones (121, 122, 123). When generating a model, a user of the transfer function generation apparatus 1 moves the sound source 2 that emits a measurement signal at an angle interval of θ and inputs azimuth angles θ, 2θ, 3θ . . . to the transfer function generation apparatus 1. Further, the sound source 2 that emits a measurement signal is moved at an elevation angle interval of ϕ and inputs elevation angles ϕ, 2ϕ, 3θ . . . to the transfer function generation apparatus 1 (FIG. 1).

When it is assumed that the argument of the sound source direction includes two elements which are the azimuth angle θ and the elevation angle ϕ, it is possible to model a transfer function H(θ, ϕ, ω) from a sound source direction (θ, ϕ) as a function of Expression (8).

$$H(\theta,\phi,\omega)=\Sigma_{m=-M}^{N}\Sigma''_{n=-N}^{N}C''_{n,m}(\omega)\exp(in\theta)\exp(im\phi) \quad (8)$$

In Expression (8), $C''_{n,m}(\omega)$ is a two-dimensional Fourier series with respect to variable numbers (θ, ϕ). Further, N is a modeling order in a horizontal direction, M is a modeling order in a perpendicular direction, and n and m are variable numbers.

In the two-dimensional modeling, it is possible to represent the modeling with respect to (θ, ϕ) as a spherical surface harmonics like Expression (9).

$$H(\theta,\phi,\omega)=\Sigma_{k=0}^{K}\Sigma_{m=-k}^{k}D(m,k,\omega)Q(m,k)P_k^{|m|}(\cos\theta)\exp(im\phi) \quad (9)$$

In Expression (9), K, M, k, and m are variable numbers. Further, $P_k^m$ (t) is an associated Legendre polynomial, Q(m, k) is a coefficient given by Expression (10), and D(m, k, ω) is a coefficient by a modeled spherical surface harmonics expansion.

$$Q(m,k)=(-1)^{(m+|m|/2)}\sqrt{\frac{2k+1}{4\pi}\frac{(k-|m|)!}{(k+|m|)!}} \quad (10)$$

The modeling coefficient in a method of each of a first pattern (Expression (1) and Expression (2)), a second pattern (Expression (3) and Expression (4)), a third pattern (Expression (7)), a fourth pattern (Expression (8)), and a fifth pattern (Expression (9)) is determined by the modeling part 14 from a transfer function that is actually measured at some angles.

The modeling part 14 performs at least one of the modeling methods described above and stores a modeling result in the storage part 15. The modeling part 14 performs this process for each of the microphones that are included in the sound-collecting part 12. When the number of microphones is three, the modeling part 14 stores three modeled transfer functions.

As described above, in the present embodiment, the modeling of the transfer function is formulated by Fourier series expansion of one dimension or two or more dimensions using one or two or more arrival directions as a main argument.

Thereby, according to the present embodiment, by using the Fourier series expansion, it is possible to represent the periodicity of the angle direction as is, and therefore, it is possible to formulate an approximation model with high accuracy compared to another linear interpolation using two points or more and the like as in the related art.

Further, according to the present embodiment, differently from the linear interpolation, there is an advantage in that the estimation accuracy is not easily degraded even at a position where the interval between data is wide. In a schematic example, when performing interpolation for restoring the original circle using data of four points on a circle, a square is restored by the linear interpolation, and on the other hand, a circle that passes through the four points is estimated by the Fourier series model. When four points are deviated, a distorted square is reconstructed by the linear interpolation, but a circle that passes through the four points is reconstructed by the Fourier series model.

In this way, according to the present embodiment, an approximation with high accuracy is available from a few points with respect to data having a smooth complex amplitude property.

[Method for Obtaining a Coefficient]

As an example, a determination method of the coefficient ($C''_n(\omega)$) when introducing the complex amplitude model given by Expression (7) to a one-dimensional transfer function database using, as a variable number, only the azimuth angle θ as the arrival direction is described. In the following description, for simplification, ω is omitted, and the coefficient is described as $C_n$.

When it is assumed that the number of transfer functions that are actually measured is L, and the azimuth angle $\theta_l$ (l=1, 2, 3 . . . L) is the arrival direction of a sound at that time, the simultaneous equations of Expression (11) are obtained.

$$H(\theta_1) = \sum_{n=-N}^{N} C_n \exp(in\theta_1) \quad (11)$$

$$H(\theta_2) = \sum_{n=-N}^{N} C_n \exp(in\theta_2)$$

$$\vdots$$

$$H(\theta_L) = \sum_{n=-N}^{N} C_n \exp(in\theta_L)$$

It is possible to describe the simultaneous equations by using a matrix and a vector as Expression (12).

$$h=Ac \quad (12)$$

In Expression (12), h is an actually measured transfer function vector, c is a coefficient vector, and A is a transfer function matrix of a model.

The vectors are Expressions (13) to (15).

$$h=[H(\theta_1)H(\theta_2) \ldots H(\theta_L)]^T \quad (13)$$

$$c=[C_{-N}C_{-N+1} \ldots C_{-1}C_{-0}C_1 \ldots C_N]^T \quad (14)$$

$$A=[a_1{}^T a_2{}^T \ldots a_1{}^T \ldots a_L{}^T]^T \quad (15)$$

In Expression (15), $a_1$ is Expression (16).

$$a_1=[\exp(-iN\theta_1) \ldots \exp(-i(N-1)\theta_1) \ldots \exp(-i\theta_l)l \; \exp(i\theta_l) \ldots \exp(iN\theta_l)] \quad (16)$$

From Expression (12), a coefficient vector c that should be obtained can be obtained from Expression (17).

$$c=A^+h \quad (17)$$

In Expression (17), $A^+$ is a pseudo-inverse matrix (Moore-Penrose pseudo-inverse matrix) of A. By Expression (17), in general, in a case where the number L of expressions is larger than the number 2N+1 of variable numbers (in a case of 2N+1>L), the coefficient is obtained as a solution in which the sum of the squares of errors becomes minimum. Further, in a case where the number L of expressions is not larger than the number 2N+1 of variable numbers (in a case of 2N+1≤L), a solution of which the norm becomes minimum among solutions of Expression (11) is obtained.

In order to calculate the coefficient of a two-dimensional transfer function database that uses the azimuth angle θ and the elevation angle ϕ as variable numbers, simultaneous equations are obtained when the number of transfer functions that are actually measured is L, and the arrival direction of a sound at that time is represented by the azimuth angle $\theta_1$ (1=1, 2, 3 . . . L) and the elevation angle $\phi_j$ (j=1, 2, 3 . . . J). The simultaneous equations can be described by using a matrix and a vector. From such described equations, a coefficient vector that should be obtained is obtained.

In a case of a digital signal, a general method of obtaining a Fourier coefficient is an inverse discrete Fourier transform. In this case, equally spaced data having the same number of points as the Fourier coefficient are required. On the other hand, when the pseudo-inverse matrix is used, the number of points of data may be small or large, and further, it is possible to obtain the coefficient even when the data are not equally spaced. The coefficient that is obtained by the pseudo-inverse matrix is a solution having no error in a case where the number of data points is equal to or more than the number of original Fourier coefficients. For example, when the pseudo-inverse matrix is used for the data that can be obtained by the inverse discrete Fourier transform, the result obtained by the pseudo-inverse matrix is matched with the result of the inverse discrete Fourier transform. There is a possibility that some of measurement data cannot be used due to a human error, incorporation of a noise, and the like. Even in such a case, by obtaining the coefficient by the pseudo-inverse matrix, it is possible to formulate a model.

First Modified Example

The above embodiment is described using an example in which a transfer function is modeled for each microphone; however, the embodiment is not limited thereto. The configuration of the transfer function generation apparatus 1 is the same as that of FIG. 1.

The modeling part 14 (FIG. 1) uses two microphones, makes a transfer function that is transmitted to a first microphone to be a reference transfer function, and models a relative transfer function obtained by dividing a transfer function that is transmitted to a second microphone by the reference transfer function. In this case, the modeling part 14 calculates a transfer function (relative transfer function) that represents an amplitude ratio and a phase difference relative to the reference transfer function and stores a coefficient of the relative transfer function in the storage part 15. In this case, the number of data stored by the storage part 15 is the number M (M is an integer equal to or more than 2) of microphones −1, and it is possible to reduce the number of data.

In this case, for example, in a case of a transfer function using an azimuth angle θ that is an arrival direction as a variable number, a transfer function that is transmitted to the first microphone may be obtained as a reference transfer function by using (Expression (1) and Expression (2)) or (Expression (3) and Expression (4)), and a relative complex amplitude property may be modeled by dividing a transfer function that is transmitted to the second microphone by the reference transfer function. The modeling part 14 may store the reference transfer function and a transfer function of another microphone that is not divided in the storage part 15.

When the number of microphones is M, one of microphones 1 to M is used as a reference, and a transfer function that is measured using the one microphone is used as a reference transfer function. Then, a relative complex amplitude property is modeled by dividing each of transfer functions measured by the remaining M−1 microphones by the reference transfer function.

Alternatively, the modeling part 14 (FIG. 1) may use two microphones, may make a transfer function that is transmitted to a first microphone to be a reference transfer function, and may model a relative complex amplitude property obtained by dividing a transfer function that is transmitted to a second microphone by the reference transfer function.

For example, in a case of a transfer function using an azimuth angle θ that is an arrival direction as a variable number, the modeling part 14 may make a transfer function that is transmitted to the first microphone to be a reference transfer function by using Expression (7), Expression (8), or Expression (9) and may model a relative complex amplitude property obtained by dividing a transfer function that is transmitted to the second microphone by the reference transfer function.

When the number of microphones is M (M is an integer equal to or more than 2), the modeling part 14 uses one of microphones 1 to M as a reference and uses a transfer function that is measured using the one microphone as a reference transfer function. Then, the modeling part 14 may model a relative complex amplitude property obtained by dividing each of transfer functions measured by the remaining M−1 microphones by the reference transfer function.

Thereby, even without providing a speaker at a sound source and measuring a transfer function, it is possible to perform localization and separation using a database that is generated according to the first modified example. In the related art (absolute transfer function database), the measurement of a transfer function to each microphone from a sound source is inevitably required, and a large amount of effort is required for the actual measurement. It is possible to generate the relative transfer function only from a collected signal. Therefore, according to the first modified example, without performing a measurement in advance, it is possible to formulate a database of a transfer function from an acoustic signal that is collected and obtained in a usage process.

The modeling part 14 may store the reference transfer function and a transfer function of another microphone that is not divided in the storage part 15. In this case, the number of data stored by the storage part 15 is the same as the number M of microphones.

In a case where the distance between the sound source and the microphone becomes large, the phase goes around, and a coefficient to a high order is required. By making a transfer function that is transmitted to a first microphone to be a reference transfer function and modeling a relative transfer function obtained by dividing a transfer function that is transmitted to a second microphone by the reference transfer function, the phase goes around moderately, and therefore, the stored order can be made a low order.

[Comparison with the Related Art]

In the related art (the technique described in Japanese Unexamined Patent Application, First Publication No. 2010-171785), a transfer function is stored at each microphone and at each arrival angle. In the related art, the complex amplitude of a transfer function is interpolated, and a transfer function of an intermediate angle without data is calculated. The interpolation is a linear interpolation using two or more points. In this way, in the related art, only the transfer function of an intermediate angle can be obtained. Further, in the related art, the angle of the transfer function that can be calculated by interpolation is required to be an integral multiple of the actually measured angle interval. Therefore, in the related art, it is impossible to obtain a transfer function value of an arbitrary intermediate angle by interpolation.

Figure 4:
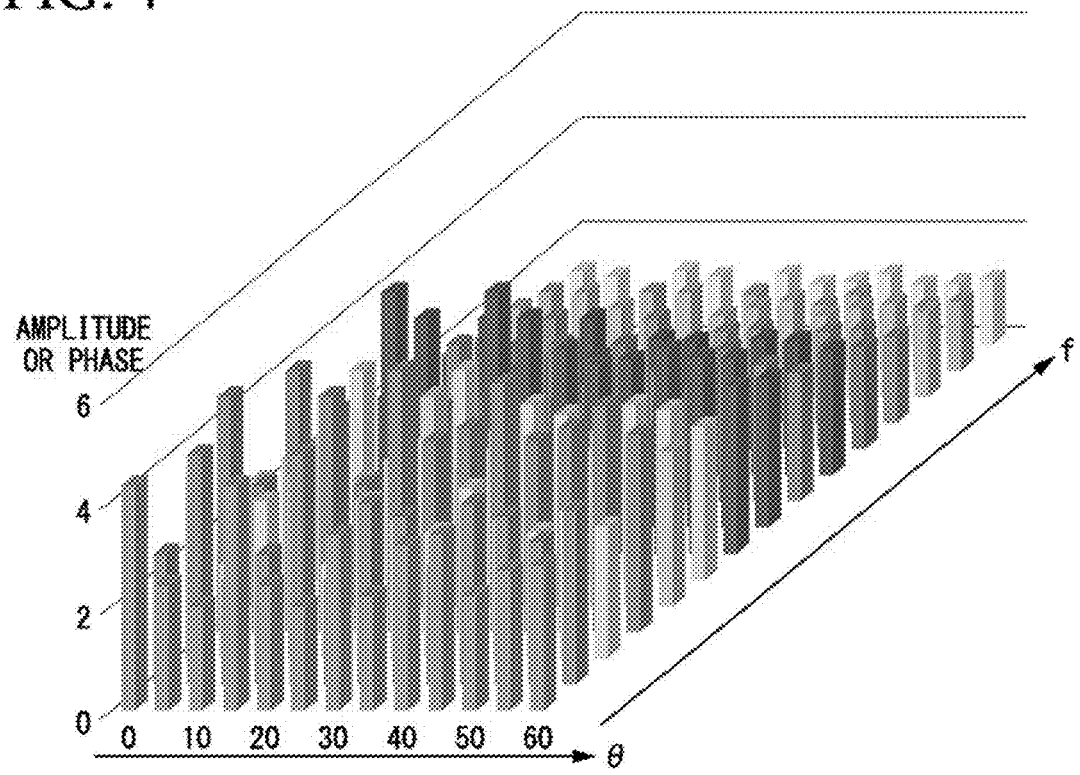
FIG. 4 is a view showing a data amount of a transfer function in the related art.

FIG. 4 is a view showing a data amount of a transfer function in the related art. In FIG. 4, the horizontal axis is an azimuth angle θ (an example of 0 to 60), the axis in the depth direction is a frequency f, and the vertical axis is an amplitude or a phase (FIG. 4 is an image view in a case of an amplitude). In this way, the number of data of the related art was the number of azimuth angles θ×the number of lines of frequencies f. Further, in the related art, both the azimuth angle θ and the frequency f were discrete.

On the other hand, in the present embodiment, a transfer function obtained by modeling by which the transfer function is represented as a function using an arrival direction as an argument is stored. That is, in the present embodiment, a transfer function is represented as the sum of the Fourier series relating to the azimuth angle θ (sound source direction). In the present embodiment, by holding only the Fourier coefficient, it is possible to represent the transfer function as a continuous function.

Figure 5:
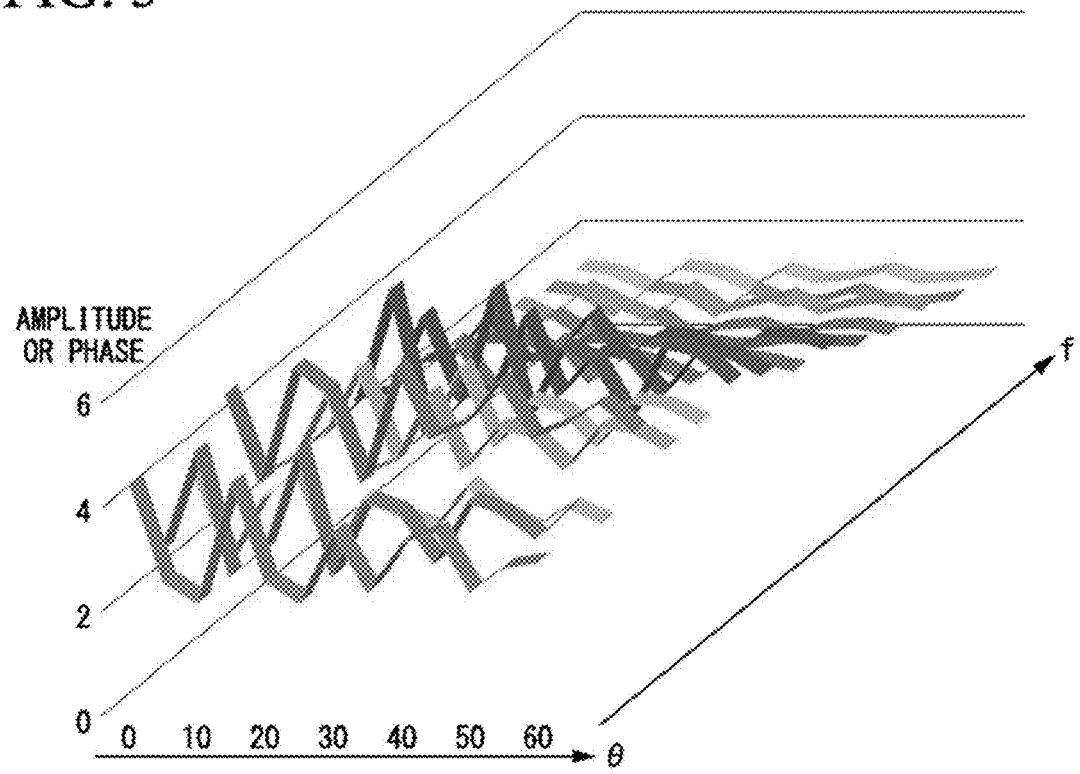
FIG. 5 is a view showing a data amount of a transfer function according to the embodiment.

FIG. 5 is a view showing a data amount of a transfer function according to the present embodiment. In FIG. 5, the horizontal axis is an azimuth angle θ (an example of 0 to 60), the axis in the depth direction is a frequency f, and the vertical axis is an amplitude or a phase. In this way, the number of data of the present embodiment is the number of Fourier coefficients×the number of lines of frequencies f. The Fourier coefficients are A, B, C, D in Expressions described above. Further, in the present embodiment, the frequency f is discrete, and the azimuth angle θ is continuous.

As a result, in the present embodiment, by using this model, it is possible to obtain a transfer function value of an arbitrary intermediate angle. Thereby, according to the present embodiment, it is possible to perform localization and separation with fine resolution. According to the present embodiment, for example, even in a state where there is only a transfer function obtained by a measurement at an interval of 5 degrees, it is possible to obtain data of localization at an interval of 1 degree, and it is possible to estimate the arrival direction of the sound source with higher accuracy. Further, according to the present embodiment, it is possible to generate a transfer function of an arbitrary sound source direction even when the number of measurement points is reduced, and therefore, it is possible to reduce the amount of stored data compared to the related art.

[Comparison of an Actual Measurement Value of a Transfer Function and a Generation Value by a Model]

Next, a comparison result of an actual measurement value of a transfer function and a generation value by a model is described with reference to FIG. 6 to FIG. 20.

Twenty-four transfer functions were measured by a measurement in which the sound sources 2 (FIG. 1) were arranged on the entire circumference at an interval of 15° on a horizontal plane. A model was formulated by expanding each of amplitude and phase characteristics of the transfer functions using the fifth-order Fourier series, and the transfer function was calculated at an interval of 5°.

I. Modeling of Each of an Amplitude Characteristic and a Phase Characteristic

First, a case where each of an amplitude characteristic and a phase characteristic is modeled by using Expression (1) and Expression (2) is described with reference to FIG. 6 to FIG. 10. The measurement was performed by collecting a sound using one microphone.

The fifth-order Fourier series means a fifth order of the Fourier coefficients, for example, as Expression (18) and Expression (19). The number of coefficients for each of the amplitude and the phase is 11 (real number).

$$|H(\theta,\omega)|=A_0(\omega)+A_1(\omega)\cos(\theta)+B_1\sin(\theta)+A_2(\omega)\cos(2\theta)+2\theta)+B_2\sin(2\theta)+\ldots+A_5(\omega)\cos(5\theta)+B_5\sin(5\theta) \tag{18}$$

$$\angle H(\theta,\omega)=A'_0(\omega)+A'_1(\omega)\cos(\theta)+B'_1(\omega)\sin(\theta)+\ldots+A'_5(\omega)\cos(5\theta)+B'_5(\omega)\sin(5\theta) \tag{19}$$

Figure 6:
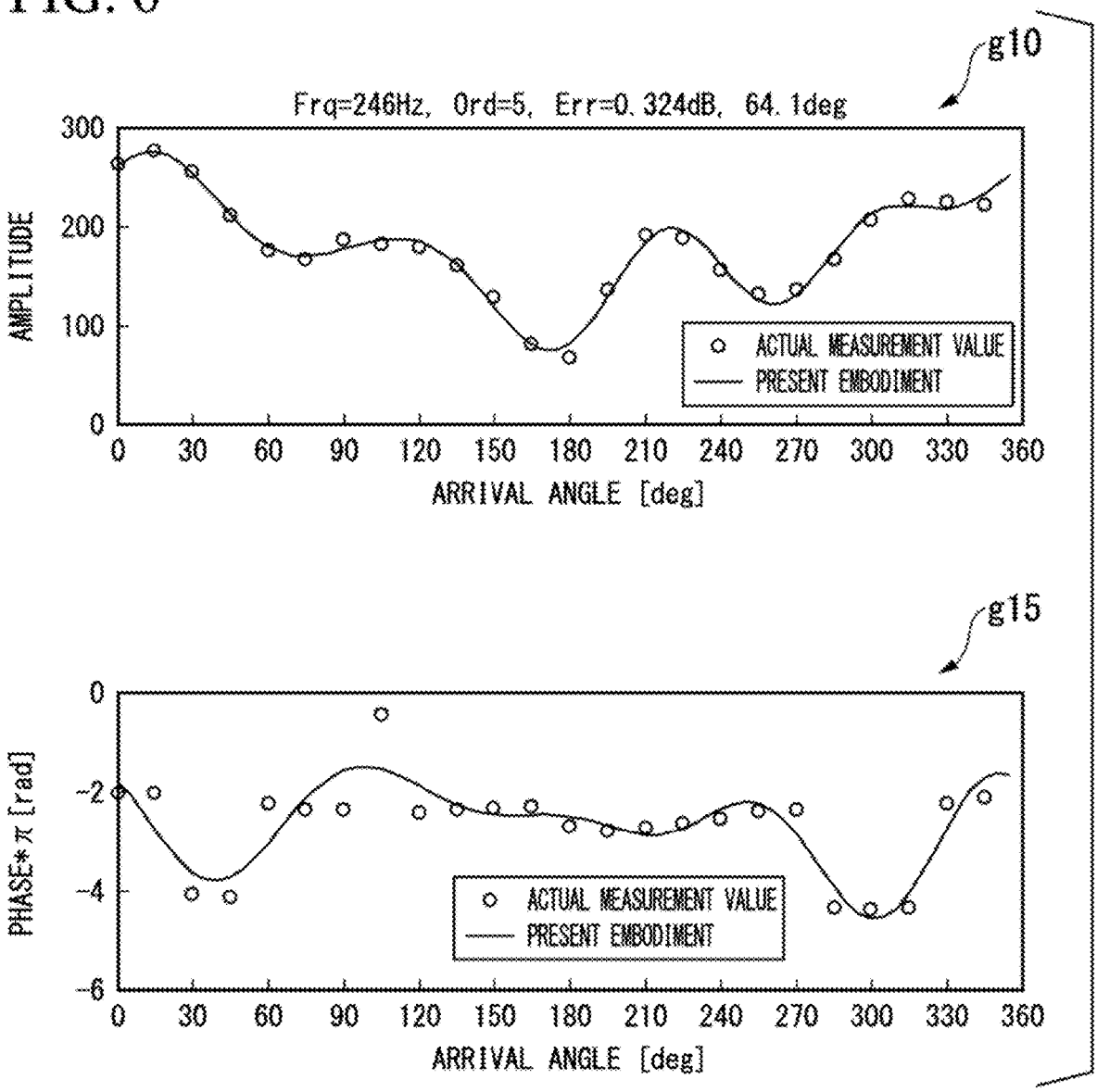
FIG. 6 is a view showing a comparison result of an actual measurement value of a transfer function and a generation value by a model in a case where each of an amplitude characteristic and a phase characteristic at a frequency of 246 Hz is modeled.

FIG. 6 is a view showing a comparison result of an actual measurement value of a transfer function and a generation value by a model in a case where each of an amplitude characteristic and a phase characteristic at a frequency of 246 Hz is modeled. In FIG. 6, a graph g10 shows a simulation result of the amplitude, and a graph g15 shows a simulation result of the phase.

In the graph g10, the horizontal axis represents an arrival angle (hereinafter, simply referred to as an angle) (deg), and the vertical axis represents an intensity (dB) of an amplitude. In the graph g15, the horizontal axis represents an angle (deg), and the vertical axis represents an intensity (×π rad) of a phase. In the graph g10 and the graph g15, a solid line shows a result that is generated by the method of the present embodiment, and a white circle shows an actual measurement value (true value).

As shown in FIG. 6, an amplitude error at 246 Hz was about 0.324 dB, and a phase error was about 64.1 deg.

It is empirically known that with respect to the amplitude, a fine variation of the actual measurement value has little impact practically. Therefore, when the tendency of the generated transfer function and the actual measurement value are close to each other, there is no problem as a transfer function practically.

Figure 7:
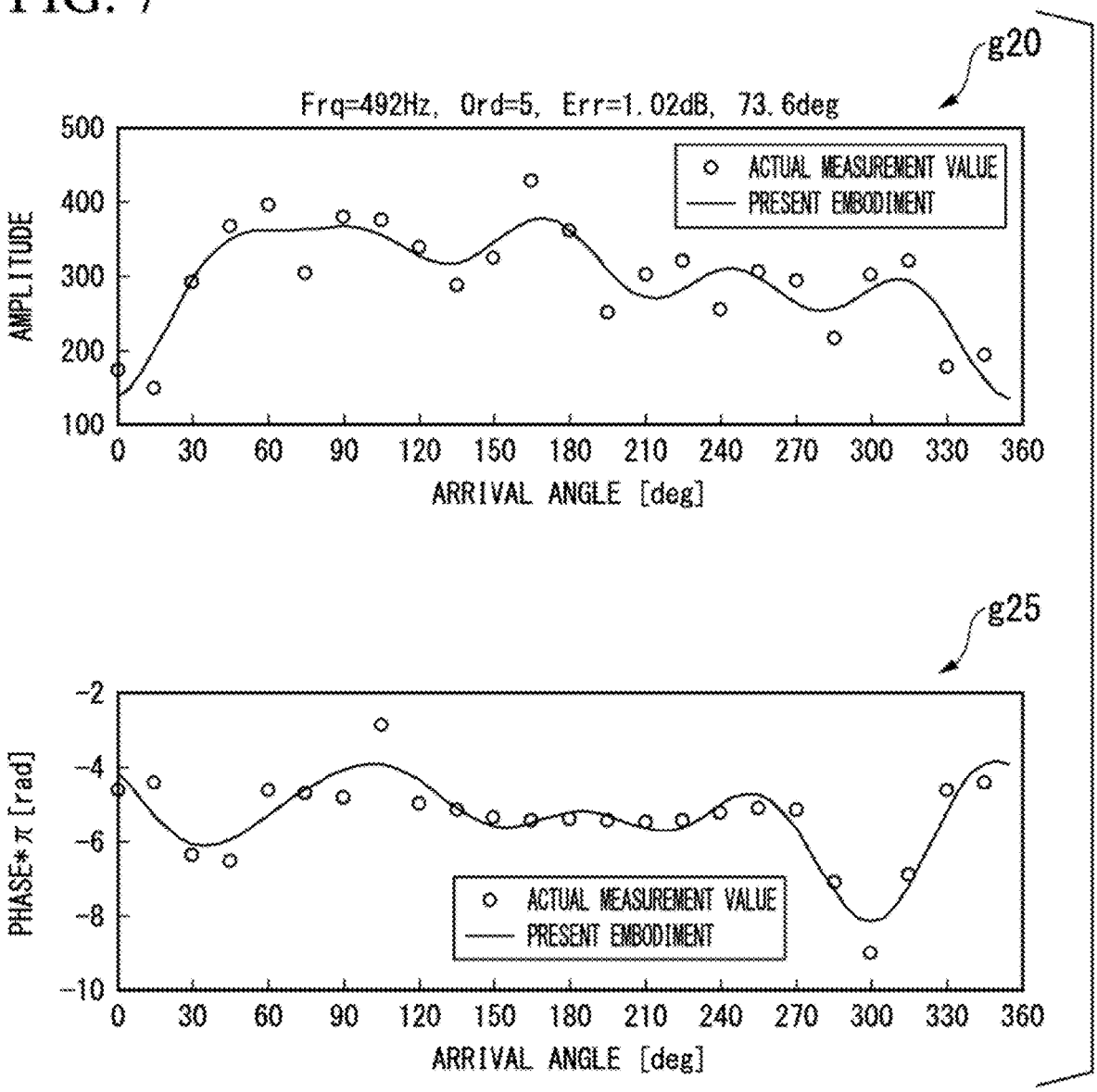
FIG. 7 is a view showing a comparison result of an actual measurement value of a transfer function and a generation value by a model in a case where each of an amplitude characteristic and a phase characteristic at a frequency of 492 Hz is modeled.

FIG. 7 is a view showing a comparison result of an actual measurement value of a transfer function and a generation value by a model in a case where each of an amplitude characteristic and a phase characteristic at a frequency of 492 Hz is modeled. In FIG. 7, a graph g20 shows a simulation result of the amplitude, and a graph g25 shows a simulation result of the phase.

In the graph g20, the horizontal axis represents an angle (deg), and the vertical axis represents an intensity (dB) of an amplitude. In the graph g25, the horizontal axis represents an angle (deg), and the vertical axis represents an intensity (×π rad) of a phase. In the graph g20 and the graph g25, a solid line shows a result that is generated by the method of the present embodiment, and a white circle shows an actual measurement value (true value).

As shown in FIG. 7, an amplitude error at 492 Hz was about 1.02 dB, and a phase error was about 73.6 deg.

Figure 8:
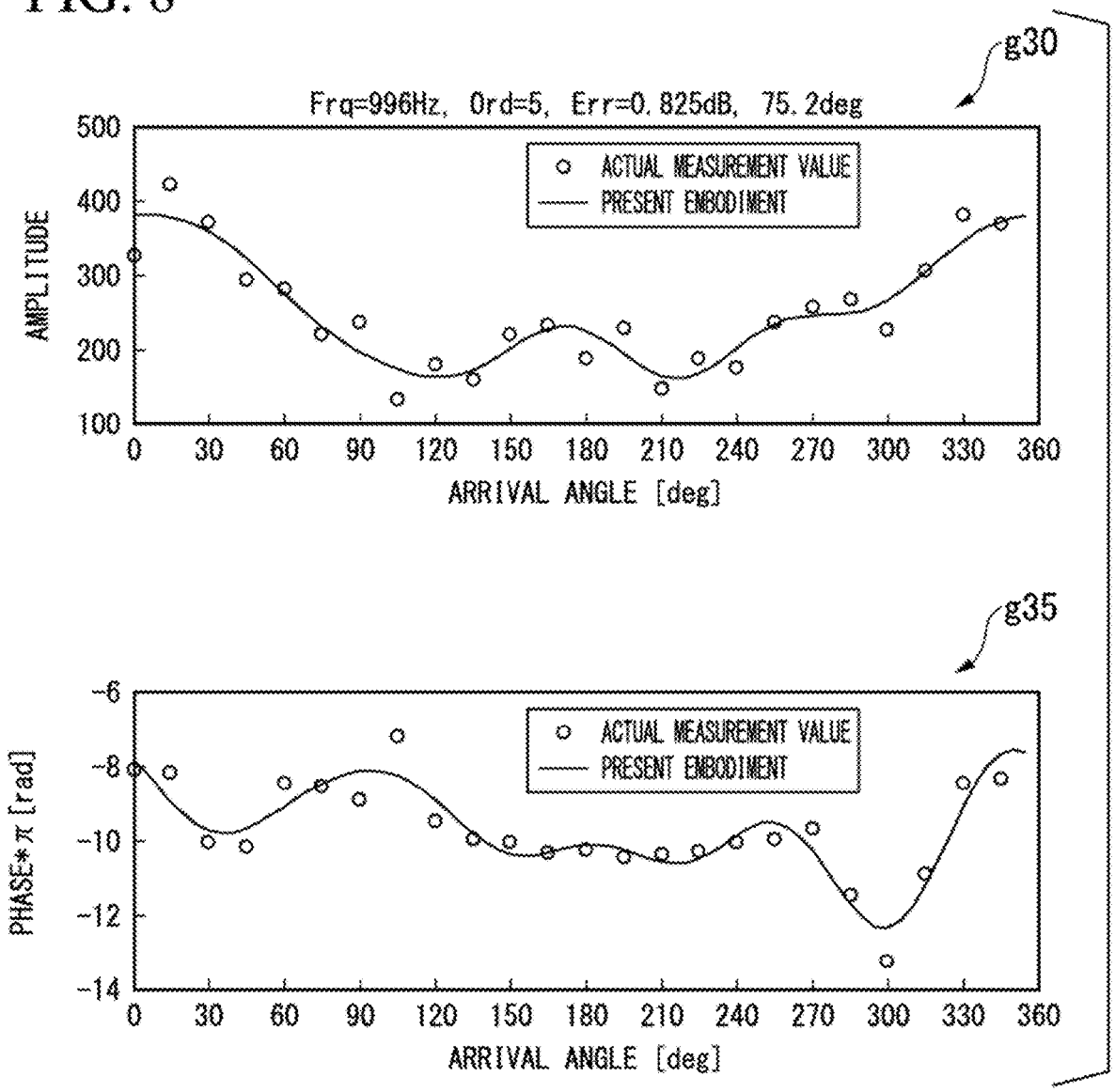
FIG. 8 is a view showing a comparison result of an actual measurement value of a transfer function and a generation value by a model in a case where each of an amplitude characteristic and a phase characteristic at a frequency of 996 Hz is modeled.

FIG. 8 is a view showing a comparison result of an actual measurement value of a transfer function and a generation value by a model in a case where each of an amplitude characteristic and a phase characteristic at a frequency of 996 Hz is modeled. In FIG. 8, a graph g30 shows a simulation result of the amplitude, and a graph g35 shows a simulation result of the phase.

In the graph g30, the horizontal axis represents an angle (deg), and the vertical axis represents an intensity (dB) of an amplitude. In the graph g35, the horizontal axis represents an angle (deg), and the vertical axis represents an intensity (×π rad) of a phase. In the graph g30 and the graph g35, a solid line shows a result that is generated by the method of the present embodiment, and a white circle shows an actual measurement value (true value).

As shown in FIG. 8, an amplitude error at 996 Hz was about 0.825 dB, and a phase error was about 75.2 deg.

Figure 9:
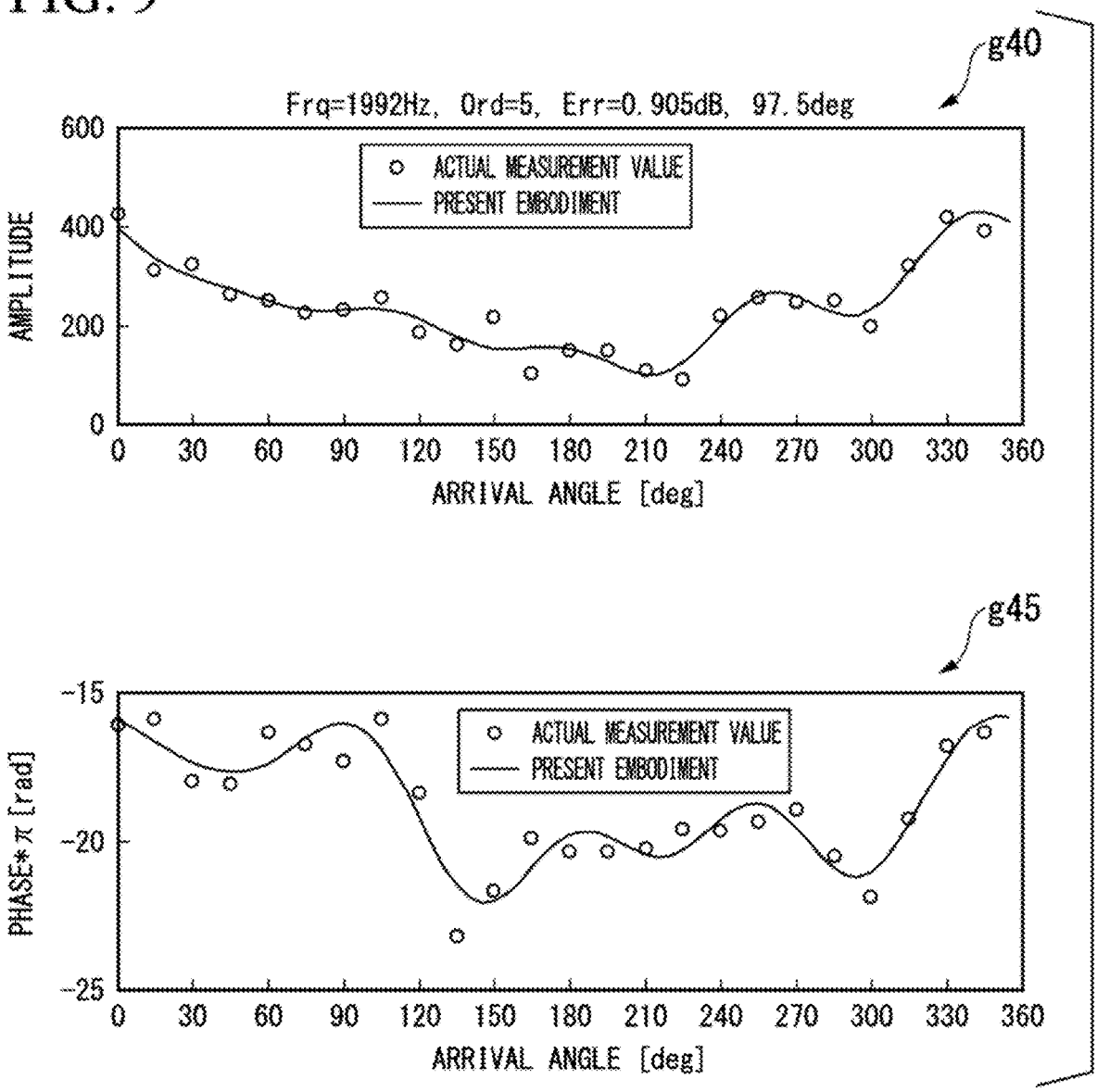
FIG. 9 is a view showing a comparison result of an actual measurement value of a transfer function and a generation value by a model in a case where each of an amplitude characteristic and a phase characteristic at a frequency of 1992 Hz is modeled.

FIG. 9 is a view showing a comparison result of an actual measurement value of a transfer function and a generation value by a model in a case where each of an amplitude characteristic and a phase characteristic at a frequency of 1992 Hz is modeled. In FIG. 9, a graph g40 shows a simulation result of the amplitude, and a graph g45 shows a simulation result of the phase.

In the graph g40, the horizontal axis represents an angle (deg), and the vertical axis represents an intensity (dB) of an amplitude. In the graph g45, the horizontal axis represents an angle (deg), and the vertical axis represents an intensity (×π rad) of a phase. In the graph g40 and the graph g45, a solid line shows a result that is generated by the method of the present embodiment, and a white circle shows an actual measurement value (true value).

As shown in FIG. 9, an amplitude error at 1992 Hz was about 0.905 dB, and a phase error was about 97.5 deg.

Figure 10:
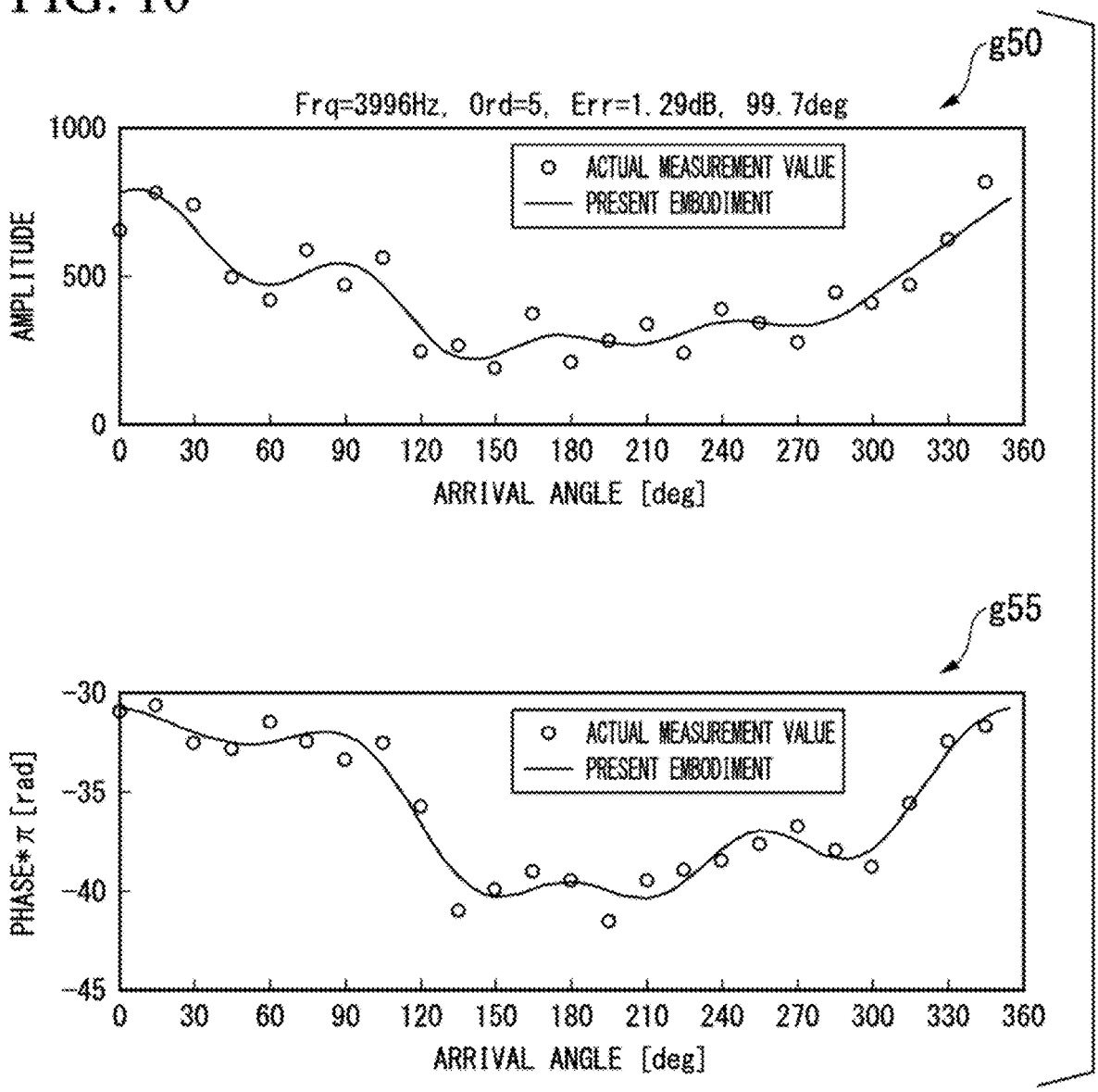
FIG. 10 is a view showing a comparison result of an actual measurement value of a transfer function and a generation value by a model in a case where each of an amplitude characteristic and a phase characteristic at a frequency of 3996 Hz is modeled.

FIG. 10 is a view showing a comparison result of an actual measurement value of a transfer function and a generation value by a model in a case where each of an amplitude characteristic and a phase characteristic at a frequency of 3996 Hz is modeled. In FIG. 10, a graph g50 shows a simulation result of the amplitude, and a graph g55 shows a simulation result of the phase.

In the graph g50, the horizontal axis represents an angle (deg), and the vertical axis represents an intensity (dB) of an amplitude. In the graph g55, the horizontal axis represents an angle (deg), and the vertical axis represents an intensity (×π rad) of a phase. In the graph g50 and the graph g55, a solid line shows a result that is generated by the method of the present embodiment, and a white circle shows an actual measurement value (true value).

As shown in FIG. 10, an amplitude error at 3996 Hz was about 1.29 dB, and a phase error was about 99.7 deg.

In the example shown in FIG. 6 to FIG. 10, a data reduction ratio (72 directions at an interval of 5°) of both the amplitude and the phase was a number of about 0.15 (11/72) in a real number. In this way, according to the present embodiment, it was possible to reduce the data to about ⅙ with respect to the database in which the transfer function is measured and stored at an interval of 5 degrees. Further, in a case where a measurement is performed at an interval of 30 degrees, the number of measurement times is only 12 times, and therefore, it is also possible to reduce the time and effort required for the measurement compared to a case where the number of measurement times is 72 times when the measurement is performed at an interval of 5 degrees.

II. Modeling of a Complex Amplitude Characteristic

Next, a case where a complex amplitude characteristic is modeled by using Expression (7) is described with reference to FIG. 11 to FIG. 15. The measurement was performed by collecting a sound using one microphone.

The number of coefficients is 11 (complex number) in the complex amplitude. The coefficient includes −5th to 5th orders and the 0 order, and the total number is 11 (complex number).

Figure 11:
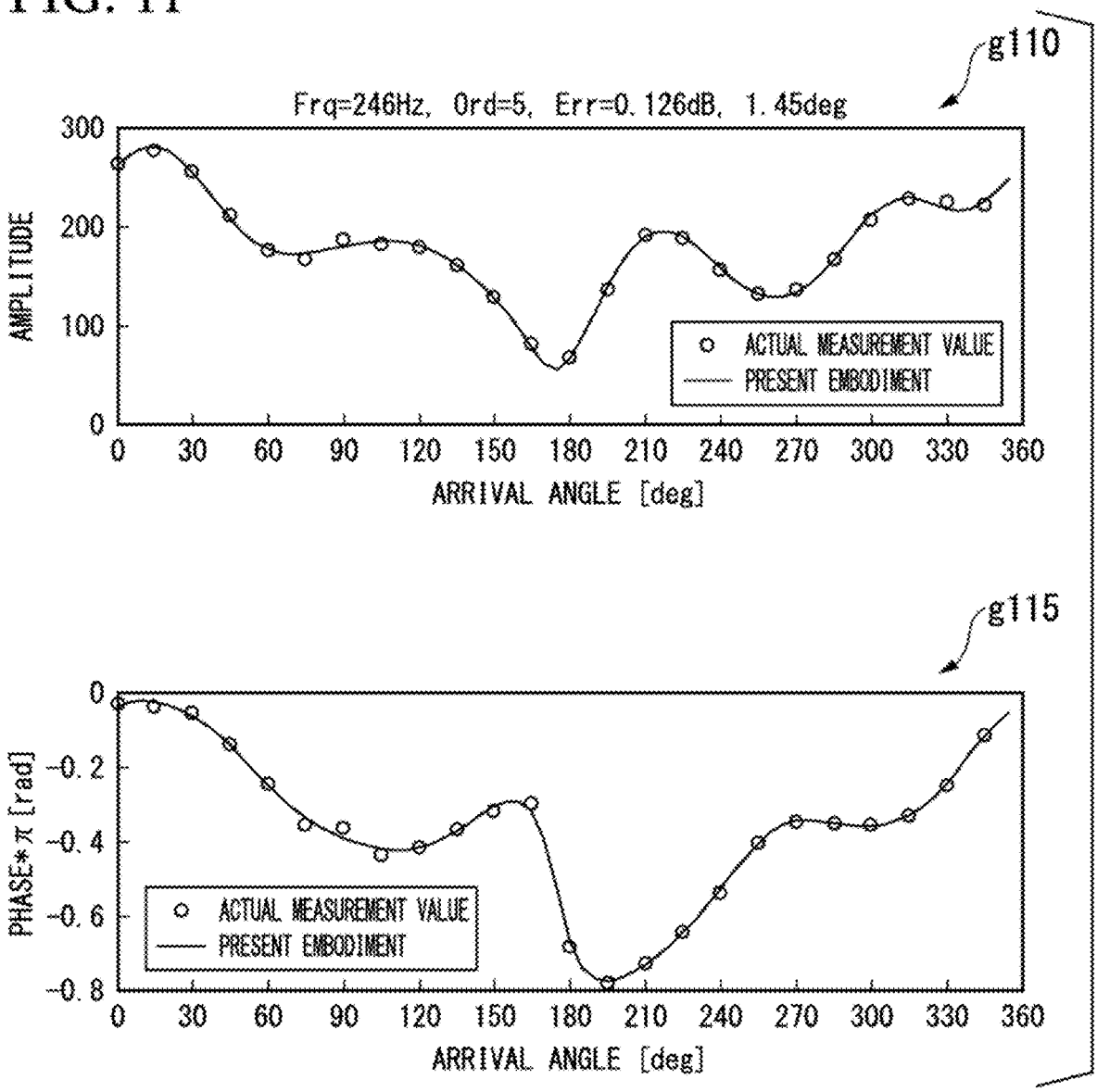
FIG. 11 is a view showing a comparison result of an actual measurement value of a transfer function and a generation value by a model in a case where a complex amplitude characteristic at a frequency of 246 Hz is modeled.

FIG. 11 is a view showing a comparison result of an actual measurement value of a transfer function and a generation value by a model in a case where a complex amplitude characteristic at a frequency of 246 Hz is modeled. In FIG. 11, a graph g110 shows a simulation result of the amplitude, and a graph g115 shows a simulation result of the phase.

In the graph g110, the horizontal axis represents an angle (deg), and the vertical axis represents an intensity of an amplitude. In the graph g115, the horizontal axis represents an angle (deg), and the vertical axis represents an intensity (×π rad) of a phase. In the graph g110 and the graph g115, a solid line shows a result that is generated by the method of the present embodiment, and a white circle shows an actual measurement value (true value).

As shown in FIG. 11, an amplitude error at 246 Hz was about 0.126 dB, and a phase error was about 1.45 deg.

Figure 12:
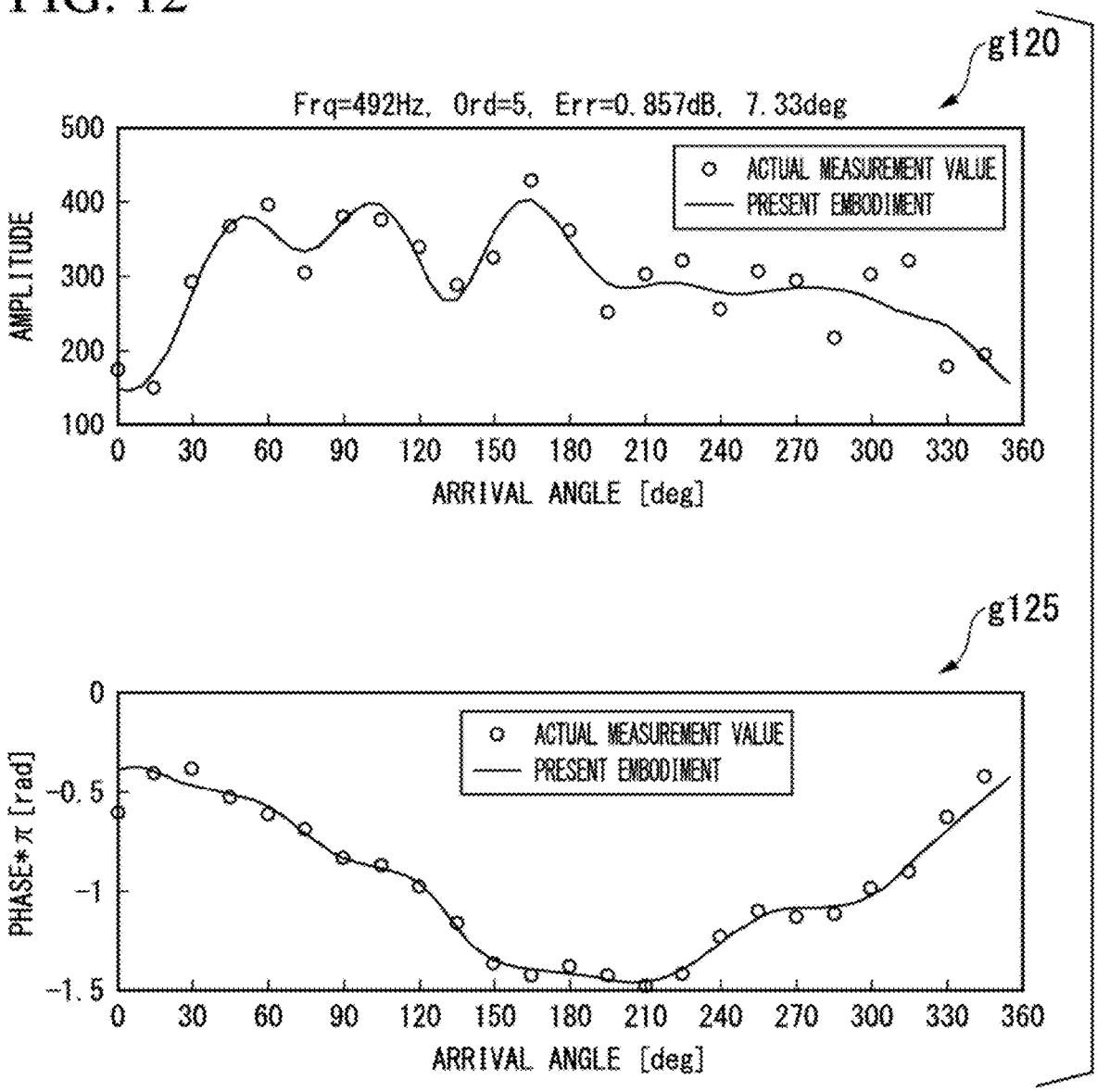
FIG. 12 is a view showing a comparison result of an actual measurement value of a transfer function and a generation value by a model in a case where a complex amplitude characteristic at a frequency of 492 Hz is modeled.

FIG. 12 is a view showing a comparison result of an actual measurement value of a transfer function and a generation value by a model in a case where a complex amplitude characteristic at a frequency of 492 Hz is modeled. In FIG. 12, a graph g120 shows a simulation result of the amplitude, and a graph g125 shows a simulation result of the phase.

In the graph g120, the horizontal axis represents an angle (deg), and the vertical axis represents an intensity of an amplitude. In the graph g125, the horizontal axis represents an angle (deg), and the vertical axis represents an intensity (×π rad) of a phase. In the graph g120 and the graph g125, a solid line shows a result that is generated by the method of the present embodiment, and a white circle shows an actual measurement value (true value).

As shown in FIG. 12, an amplitude error at 492 Hz was about 0.857 dB, and a phase error was about 7.33 deg.

Figure 13:
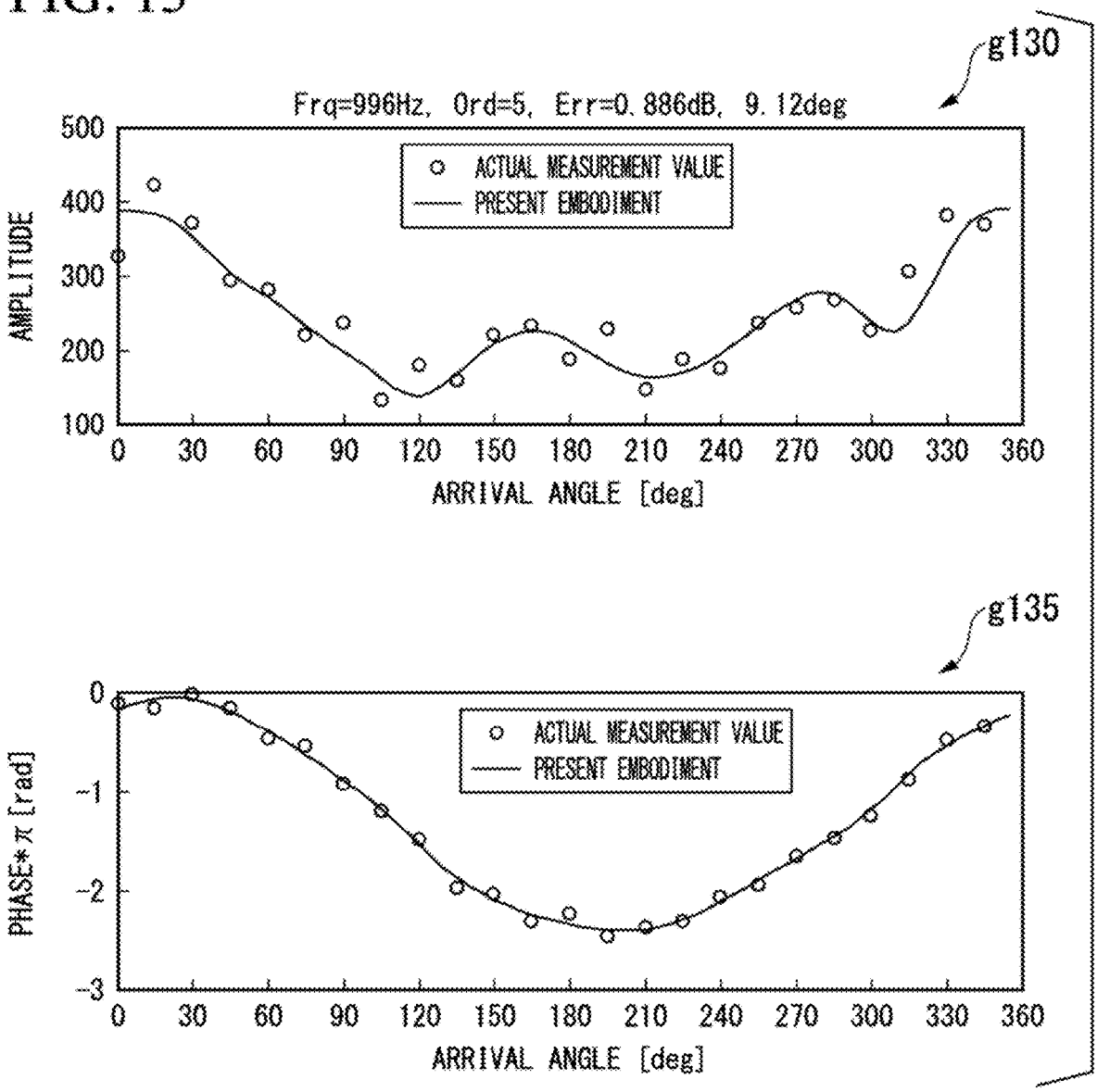
FIG. 13 is a view showing a comparison result of an actual measurement value of a transfer function and a generation value by a model in a case where a complex amplitude characteristic at a frequency of 996 Hz is modeled.

FIG. 13 is a view showing a comparison result of an actual measurement value of a transfer function and a generation value by a model in a case where a complex amplitude characteristic at a frequency of 996 Hz is modeled. In FIG. 13, a graph g130 shows a simulation result of the amplitude, and a graph g135 shows a simulation result of the phase.

In the graph g130, the horizontal axis represents an angle (deg), and the vertical axis represents an intensity of an amplitude. In the graph g135, the horizontal axis represents an angle (deg), and the vertical axis represents an intensity (×π rad) of a phase.

In the graph g130 and the graph g135, a solid line shows a result that is generated by the method of the present embodiment, and a white circle shows an actual measurement value (true value).

As shown in FIG. 13, an amplitude error at 996 Hz was about 0.886 dB, and a phase error was about 9.12 deg.

Figure 14:
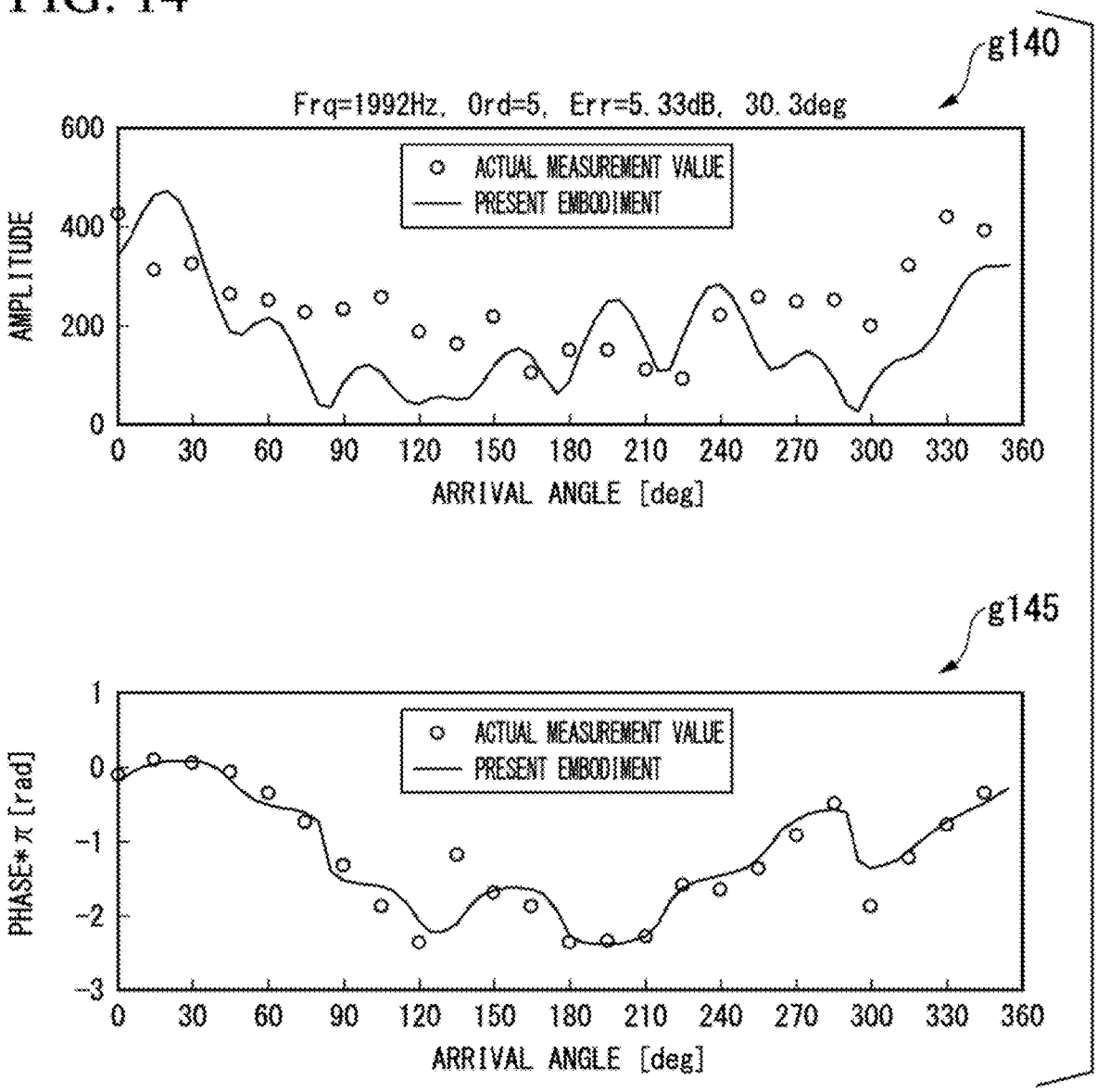
FIG. 14 is a view showing a comparison result of an actual measurement value of a transfer function and a generation value by a model in a case where a complex amplitude characteristic at a frequency of 1992 Hz is modeled.

FIG. 14 is a view showing a comparison result of an actual measurement value of a transfer function and a generation value by a model in a case where a complex amplitude characteristic at a frequency of 1992 Hz is modeled. In FIG. 14, a graph g140 shows a simulation result of the amplitude, and a graph g145 shows a simulation result of the phase.

In the graph g140, the horizontal axis represents an angle (deg), and the vertical axis represents an intensity of an amplitude. In the graph g145, the horizontal axis represents an angle (deg), and the vertical axis represents an intensity (×π rad) of a phase. In the graph g140 and the graph g145, a solid line shows a result that is generated by the method of the present embodiment, and a white circle shows an actual measurement value (true value).

As shown in FIG. 14, an amplitude error at 1992 Hz was about 5.33 dB, and a phase error was about 30.3 deg.

Figure 15:
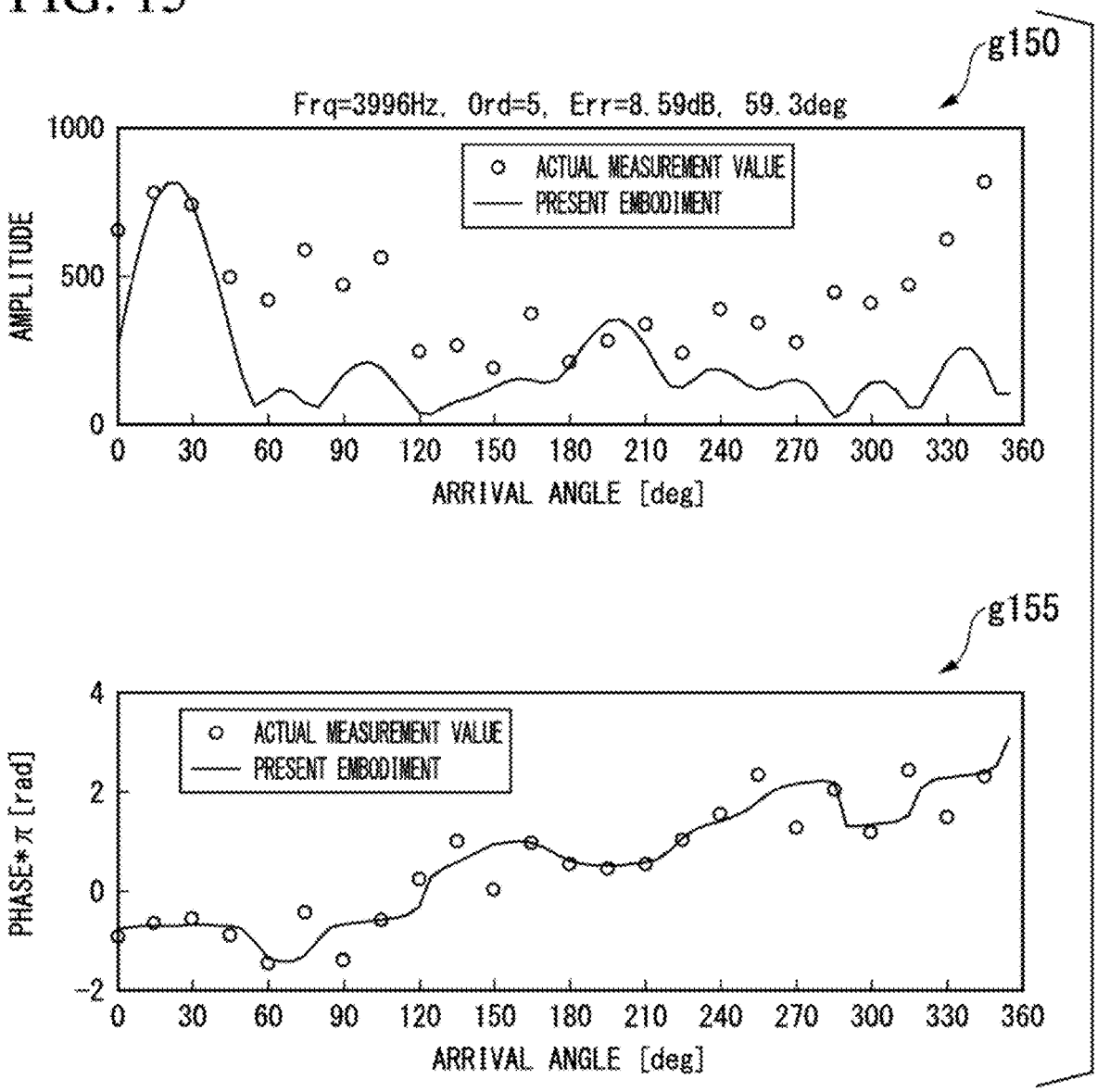
FIG. 15 is a view showing a comparison result of an actual measurement value of a transfer function and a generation value by a model in a case where a complex amplitude characteristic at a frequency of 3996 Hz is modeled.

FIG. 15 is a view showing a comparison result of an actual measurement value of a transfer function and a generation value by a model in a case where a complex amplitude characteristic at a frequency of 3996 Hz is modeled. In FIG. 15, a graph g150 shows a simulation result of the amplitude, and a graph g155 shows a simulation result of the phase.

In the graph g150, the horizontal axis represents an angle (deg), and the vertical axis represents an intensity of an amplitude. In the graph g155, the horizontal axis represents an angle (deg), and the vertical axis represents an intensity (×π rad) of a phase. In the graph g150 and the graph g155, a solid line shows a result that is generated by the method of the present embodiment, and a white circle shows an actual measurement value (true value).

As shown in FIG. 15, an amplitude error at 3996 Hz was about 8.59 dB, and a phase error was about 59.3 deg.

When FIG. 6 to FIG. 10 are compared with FIG. 11 to FIG. 15, it is found that with respect to the phase characteristic, the difference between the actual measurement value and the value by the model is smaller at the measurement point of FIG. 11 to FIG. 15 compared to FIG. 6 to FIG. 10, and the modeling using the complex amplitude is a model with higher accuracy.

Further, in the example shown in FIG. 11 to FIG. 15, a data reduction ratio (72 directions at an interval of 5°) of both the amplitude and the phase was a number of about 0.15 (11/72) in a complex number. In this way, according to the present embodiment, it was possible to reduce the data to about ⅙ with respect to the database in which the transfer function is measured and stored at an interval of 5 degrees.

III. Modeling of a Relative Complex Amplitude Characteristic

Next, a case of using two microphones and modeling a relative complex amplitude characteristic obtained by: making a transfer function that is transmitted to a first microphone to be a reference transfer function; and dividing a transfer function that is transmitted to a second microphone by the reference transfer function, is described with reference to FIG. 16 to FIG. 20.

The number of coefficients is 11 (complex number) in the complex amplitude. The coefficient includes −5th to 5th orders and the 0 order, and the total number is 11 (complex number).

Figure 16:
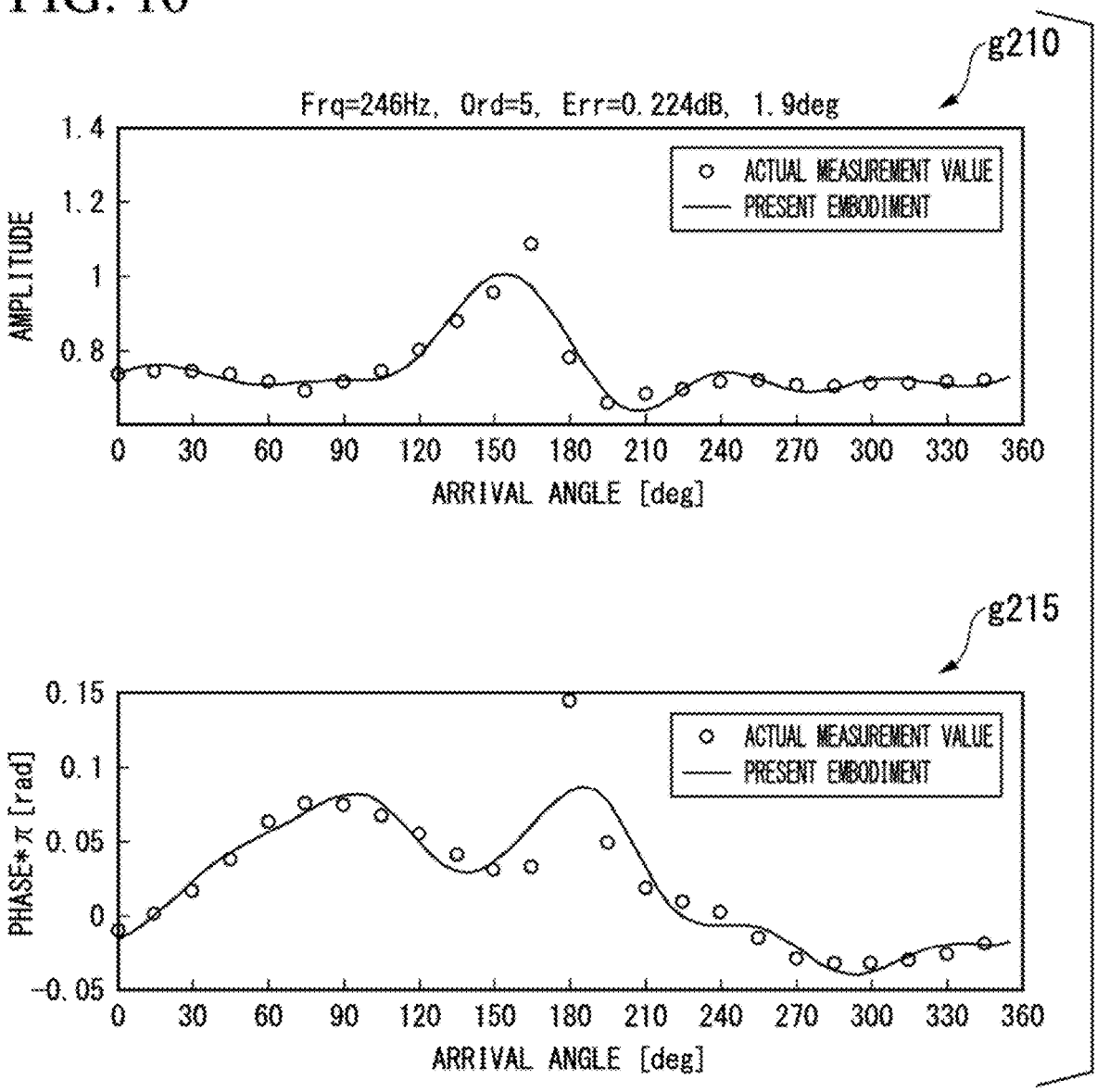
FIG. 16 is a view showing a comparison result of an actual measurement value of a relative transfer function and a generation value by a model in a case where a complex amplitude characteristic at a frequency of 246 Hz is modeled.

FIG. 16 is a view showing a comparison result of an actual measurement value of a relative transfer function and a generation value by a model in a case where a complex amplitude characteristic at a frequency of 246 Hz is modeled. In FIG. 16, a graph g210 shows a simulation result of the amplitude, and a graph g215 shows a simulation result of the phase.

In the graph g210, the horizontal axis represents an angle (deg), and the vertical axis represents an intensity of an amplitude. In the graph g215, the horizontal axis represents an angle (deg), and the vertical axis represents an intensity (×π rad) of a phase. In the graph g210 and the graph g215, a solid line shows a result that is generated by the method of the present embodiment, and a white circle shows an actual measurement value (true value).

As shown in FIG. 16, an amplitude error at 246 Hz was about 0.224 dB, and a phase error was about 1.9 deg.

Figure 17:
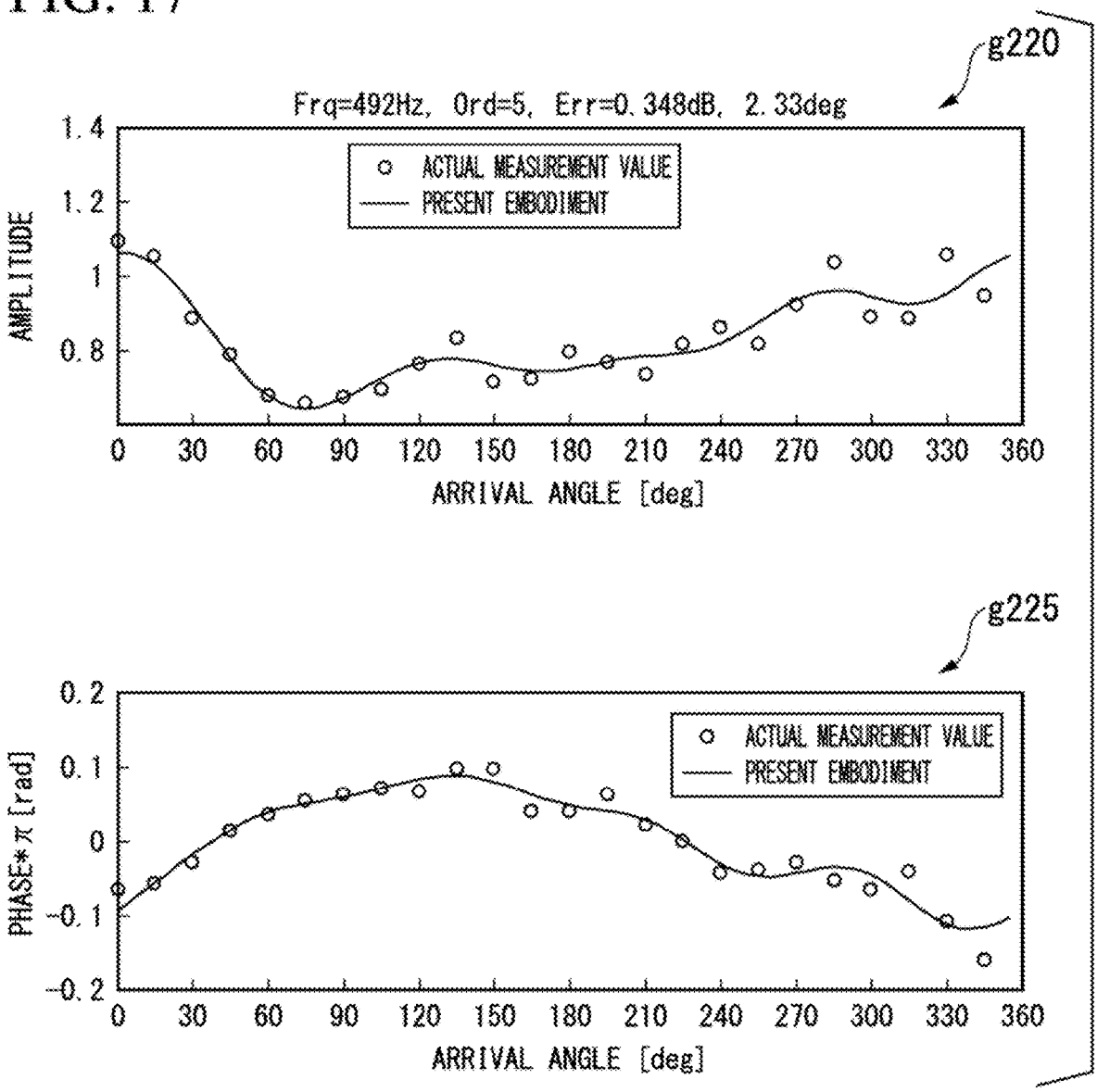
FIG. 17 is a view showing a comparison result of an actual measurement value of a relative transfer function and a generation value by a model in a case where a complex amplitude characteristic at a frequency of 492 Hz is modeled.

FIG. 17 is a view showing a comparison result of an actual measurement value of a relative transfer function and a generation value by a model in a case where a complex amplitude characteristic at a frequency of 492 Hz is modeled. In FIG. 17, a graph g220 shows a simulation result of the amplitude, and a graph g225 shows a simulation result of the phase.

In the graph g220, the horizontal axis represents an angle (deg), and the vertical axis represents an intensity of an amplitude. In the graph g225, the horizontal axis represents an angle (deg), and the vertical axis represents an intensity (×π rad) of a phase. In the graph g220 and the graph g225, a solid line shows a result that is generated by the method of the present embodiment, and a white circle shows an actual measurement value (true value).

As shown in FIG. 17, an amplitude error at 492 Hz was about 0.348 dB, and a phase error was about 2.33 deg.

Figure 18:
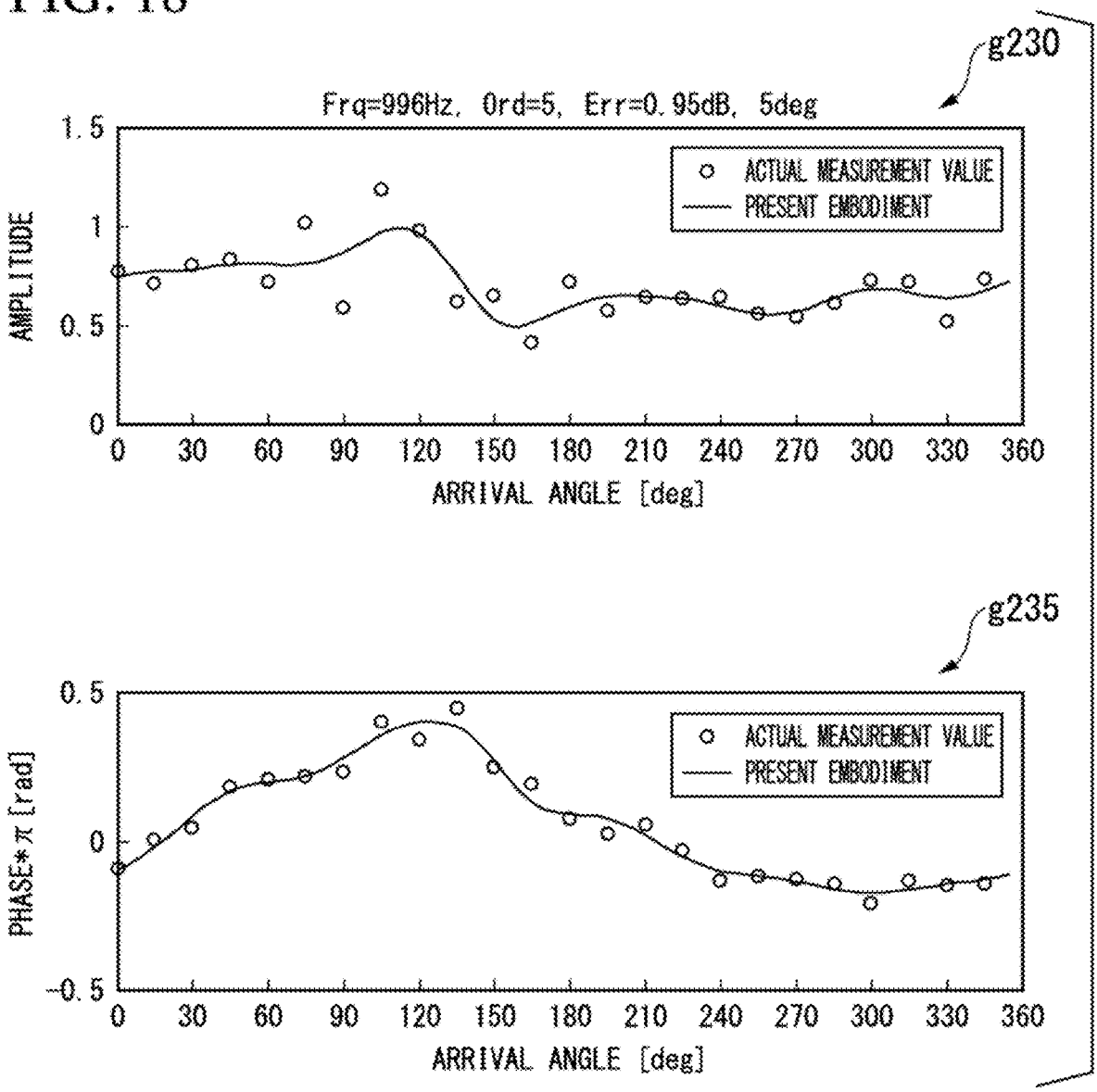
FIG. 18 is a view showing a comparison result of an actual measurement value of a relative transfer function and a generation value by a model in a case where a complex amplitude characteristic at a frequency of 996 Hz is modeled.

FIG. 18 is a view showing a comparison result of an actual measurement value of a relative transfer function and a generation value by a model in a case where a complex amplitude characteristic at a frequency of 996 Hz is modeled. In FIG. 18, a graph g230 shows a simulation result of the amplitude, and a graph g235 shows a simulation result of the phase.

In the graph g230, the horizontal axis represents an angle (deg), and the vertical axis represents an intensity of an amplitude. In the graph g235, the horizontal axis represents an angle (deg), and the vertical axis represents an intensity (×π rad) of a phase. In the graph g230 and the graph g235, a solid line shows a result that is generated by the method of the present embodiment, and a white circle shows an actual measurement value (true value).

As shown in FIG. 18, an amplitude error at 996 Hz was about 0.95 dB, and a phase error was about 5 deg.

Figure 19:
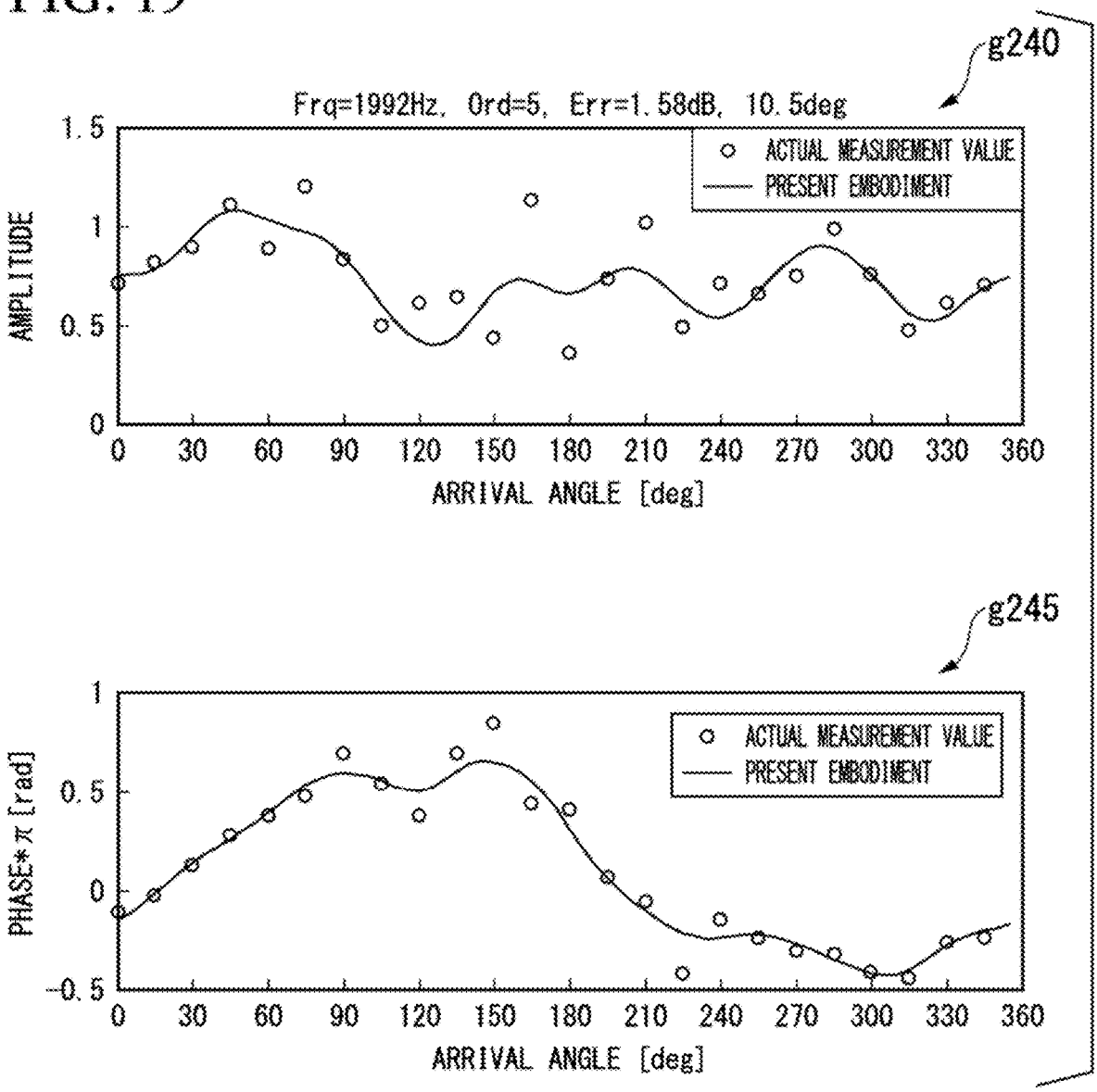
FIG. 19 is a view showing a comparison result of an actual measurement value of a relative transfer function and a generation value by a model in a case where a complex amplitude characteristic at a frequency of 1992 Hz is modeled.

FIG. 19 is a view showing a comparison result of an actual measurement value of a relative transfer function and a generation value by a model in a case where a complex amplitude characteristic at a frequency of 1992 Hz is modeled. In FIG. 19, a graph g240 shows a simulation result of the amplitude, and a graph g245 shows a simulation result of the phase.

In the graph g240, the horizontal axis represents an angle (deg), and the vertical axis represents an intensity of an amplitude. In the graph g245, the horizontal axis represents an angle (deg), and the vertical axis represents an intensity (×π rad) of a phase. In the graph g240 and the graph g245, a solid line shows a result that is generated by the method of the present embodiment, and a white circle shows an actual measurement value (true value).

As shown in FIG. 19, an amplitude error at 1992 Hz was about 1.58 dB, and a phase error was about 10.5 deg.

Figure 20:
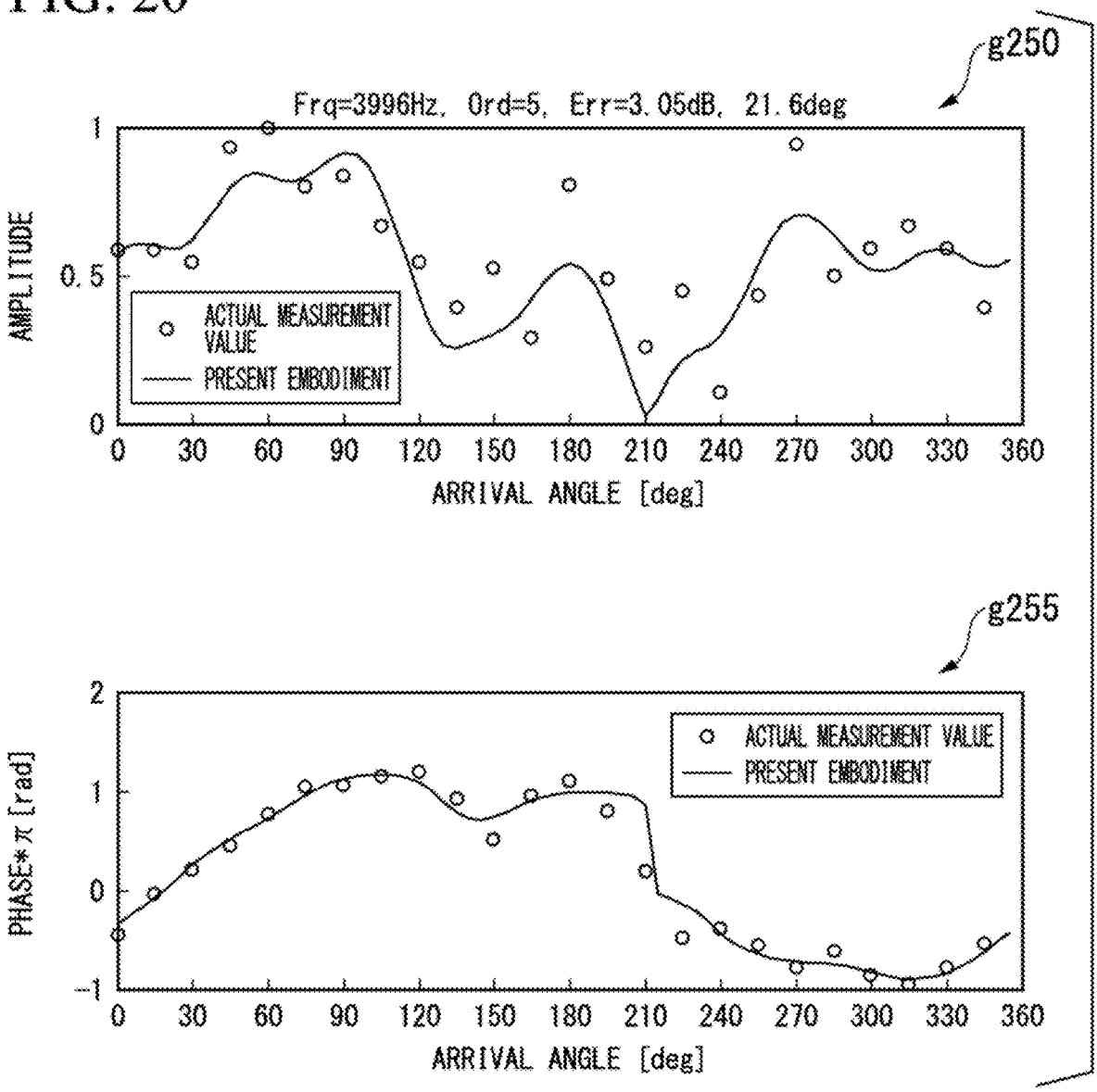
FIG. 20 is a view showing a comparison result of an actual measurement value of a relative transfer function and a generation value by a model in a case where a complex amplitude characteristic at a frequency of 3996 Hz is modeled.

FIG. 20 is a view showing a comparison result of an actual measurement value of a relative transfer function and a generation value by a model in a case where a complex amplitude characteristic at a frequency of 3996 Hz is modeled. In FIG. 20, a graph g250 shows a simulation result of the amplitude, and a graph g255 shows a simulation result of the phase.

In the graph g250, the horizontal axis represents an angle (deg), and the vertical axis represents an intensity of an amplitude. In the graph g255, the horizontal axis represents an angle (deg), and the vertical axis represents an intensity (×π rad) of a phase.

In the graph g250 and the graph g255, a solid line shows a result that is generated by the method of the present embodiment, and a white circle shows an actual measurement value (true value).

As shown in FIG. 20, an amplitude error at 3996 Hz was about 3.05 dB, and a phase error was about 21.6 deg.

When FIG. 16 to FIG. 20 are compared with FIG. 11 to FIG. 15, by the relativization, the amplitude characteristic is flattened, and the change of the phase characteristic is decreased. Thereby, it is found that the error of modeling is decreased.

In the example shown in FIG. 16 to FIG. 20, a data reduction ratio (72 directions at an interval of 5°) of both the amplitude and the phase was a number of about 0.15 (11/72) in a complex number. In this way, according to the present embodiment, it was possible to reduce the data to about ⅙ with respect to the database in which the transfer function is measured and stored at an interval of 5 degrees.

As described above, according to the present embodiment, as described with reference to FIG. 6 to FIG. 20, by expanding and modeling a transfer function obtained by a measurement at an interval of 30 degrees using the fifth-order Fourier series, it was possible to generate a transfer function equal to a result of an actual measurement at an interval of 5 degrees. In this way, according to the present embodiment, it is possible to generate a transfer function of an arbitrary angle with a small number of data, and it is possible to generate a model of a transfer function as a continuous model as a function of an angle (an azimuth angle, an elevation angle) of the sound source direction.

The embodiment is described using an example of modeling by expansion using the fifth-order Fourier series. However, the order is not limited thereto and may be smaller or larger than five. When the order is smaller than five, it is possible to further reduce the amount of data.

IV. Frequency Characteristics of a Complex Fourier Series Model Approximation Error of a Relative Transfer Function Depending on an Order of a Modeling Coefficient Next, frequency characteristics of a complex Fourier series model approximation error of a relative transfer function depending on an order of a modeling coefficient are described.

Figure 21:
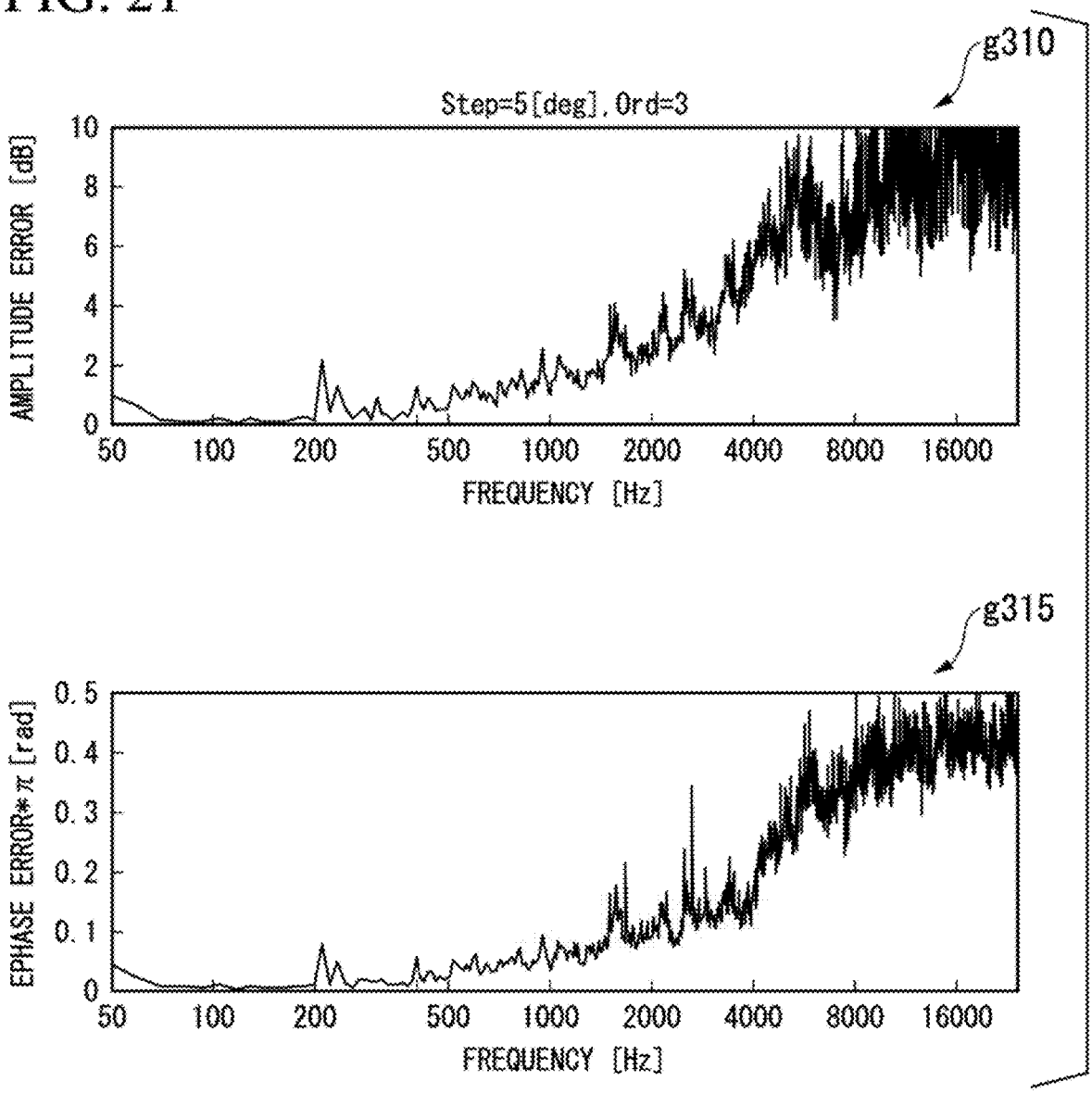
FIG. 21 is a view showing an amplitude error and a phase error with respect to a frequency in a case where the order of modeling is 3.

FIG. 21 is a view showing an amplitude error and a phase error with respect to a frequency in a case where the order of modeling is 3. The number of coefficients is 7. The interval of arrival angles is 5 degrees.

In FIG. 21, a graph g310 shows an amplitude error with respect to a frequency, and a graph g315 shows a phase error with respect to a frequency.

In the graph g310, the horizontal axis represents a frequency (Hz), and the vertical axis represents an amplitude error (dB). In the graph g315, the horizontal axis represents a frequency (Hz), and the vertical axis represents a phase error (×π rad).

When the order is 3, a data reduction ratio is about 0.097 (=7/72). In this way, when the order is 3, it is possible to reduce the data to about ⅙ with respect to the database in which the transfer function is measured and stored at an interval of 5 degrees.

Figure 22:
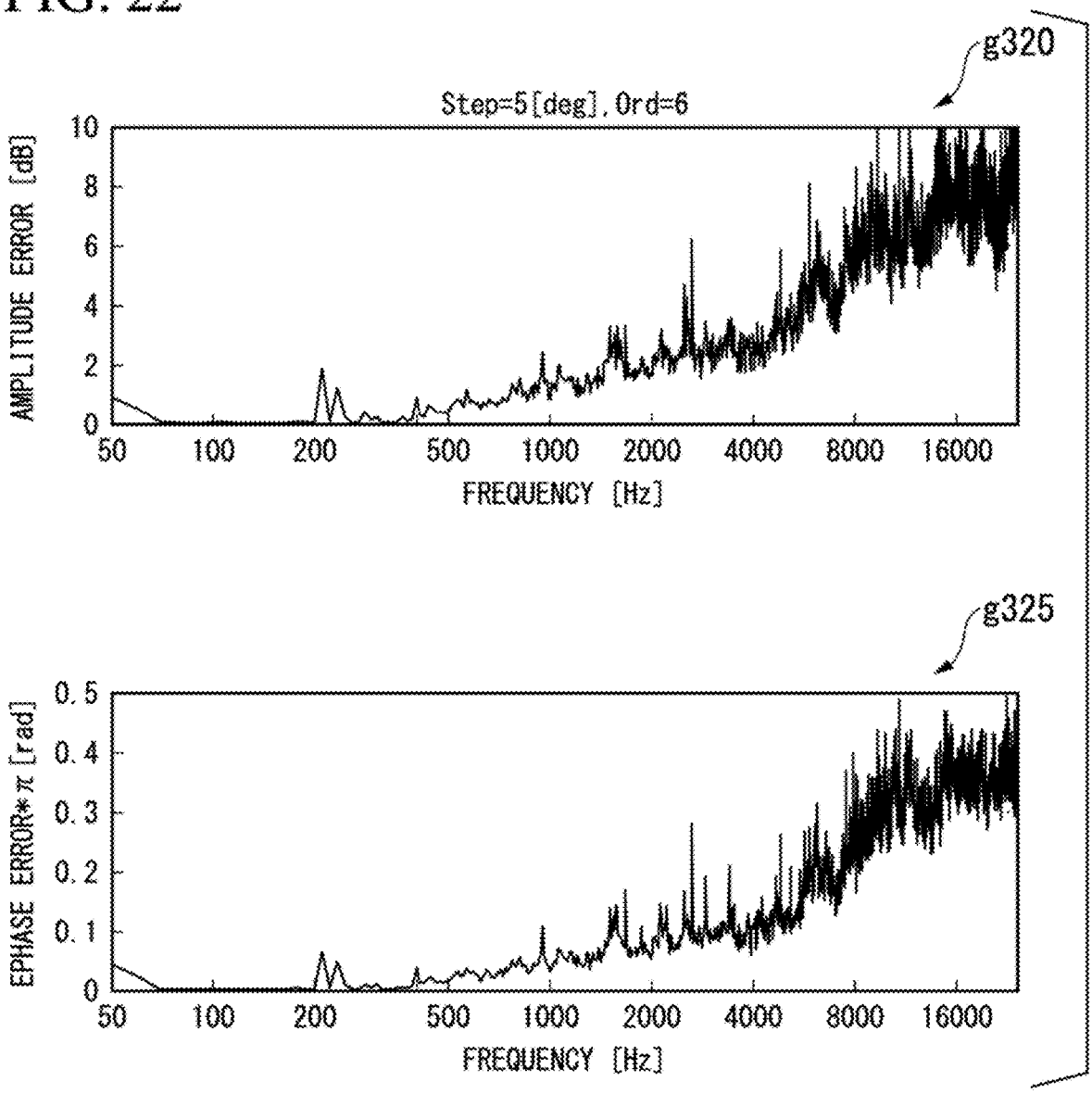
FIG. 22 is a view showing an amplitude error and a phase error with respect to a frequency in a case where the order of modeling is 6.

FIG. 22 is a view showing an amplitude error and a phase error with respect to a frequency in a case where the order of modeling is 6. The number of coefficients is 13.

In FIG. 22, a graph g320 shows an amplitude error with respect to a frequency, and a graph g325 shows a phase error with respect to a frequency.

In the graph g320, the horizontal axis represents a frequency (Hz), and the vertical axis represents an amplitude error (dB). In the graph g325, the horizontal axis represents a frequency (Hz), and the vertical axis represents a phase error (×π rad).

When the order is 6, a data reduction ratio is about 0.181 (=13/72). In this way, when the order is 6, it is possible to reduce the data to about 1/5.5.

Figure 23:
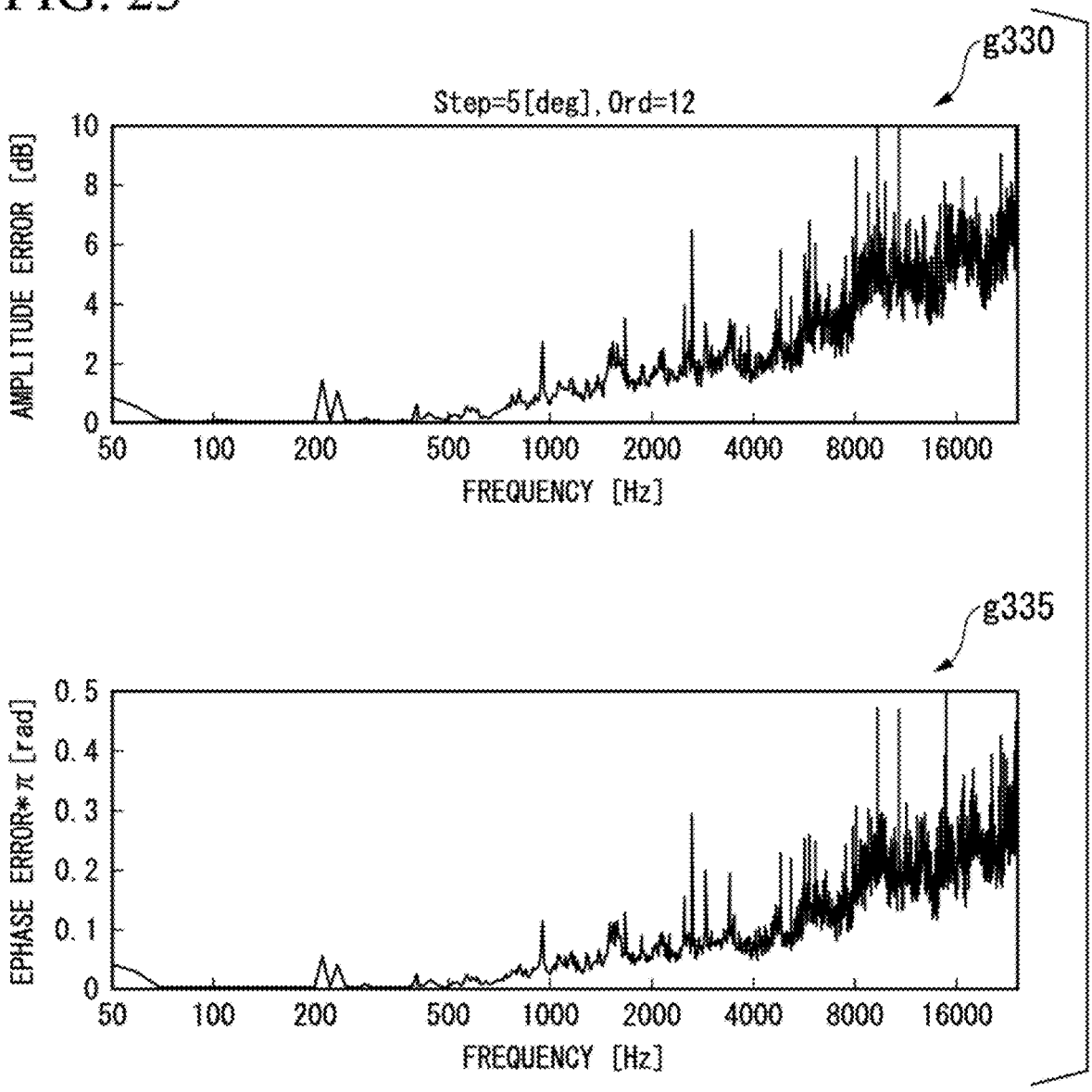
FIG. 23 is a view showing an amplitude error and a phase error with respect to a frequency in a case where the order of modeling is 12.

FIG. 23 is a view showing an amplitude error and a phase error with respect to a frequency in a case where the order of modeling is 12. The number of coefficients is 25.

In FIG. 23, a graph g330 shows an amplitude error with respect to a frequency, and a graph g335 shows a phase error with respect to a frequency.

In the graph g330, the horizontal axis represents a frequency (Hz), and the vertical axis represents an amplitude error (dB). In the graph g335, the horizontal axis represents a frequency (Hz), and the vertical axis represents a phase error (×π rad).

When the order is 12, a data reduction ratio is about 0.347 (=25/72). In this way, when the order is 12, it is possible to reduce the data to about ⅓.

As shown in FIG. 21 to FIG. 23, as the order of modeling becomes larger, the frequency characteristic becomes better.

V. Frequency Characteristics of a Complex Fourier Series Model Approximation Error of a Relative Transfer Function Depending on an Angle Interval of a Transfer Function Next, frequency characteristics of a complex Fourier series model approximation error of a relative transfer function depending on an angle interval (an interval of arrival angles) of a transfer function are described.

Figure 24:
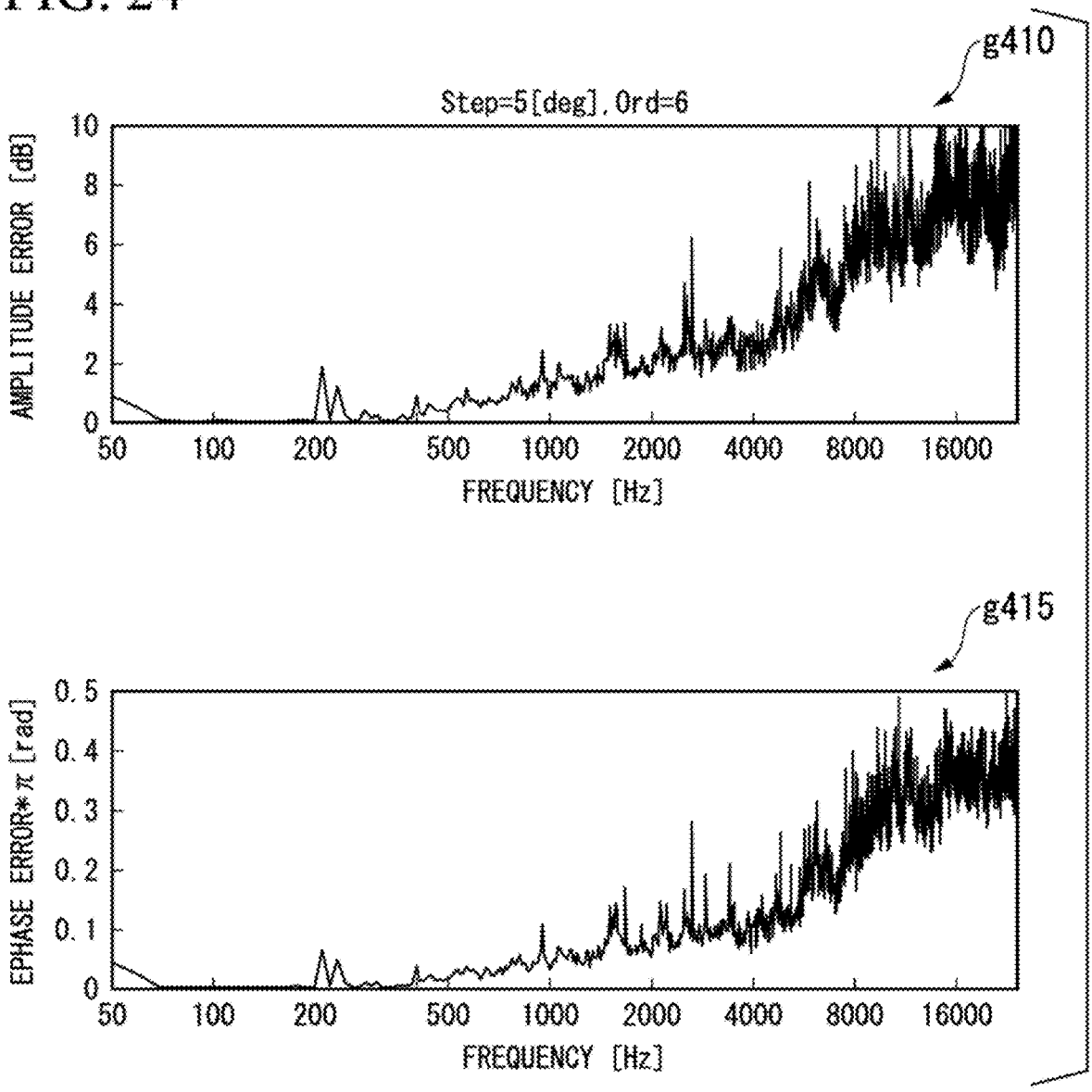
FIG. 24 is a view showing an amplitude error and a phase error with respect to a frequency in a case where an angle interval of a transfer function is 5 degrees.

FIG. 24 is a view showing an amplitude error and a phase error with respect to a frequency in a case where the angle interval of the transfer function is 5 degrees. The order of modeling is 6.

In FIG. 24, a graph g410 shows an amplitude error with respect to a frequency, and a graph g415 shows a phase error with respect to a frequency.

In the graph g410, the horizontal axis represents a frequency (Hz), and the vertical axis represents an amplitude error (dB). In the graph g415, the horizontal axis represents a frequency (Hz), and the vertical axis represents a phase error (×π rad).

Figure 25:
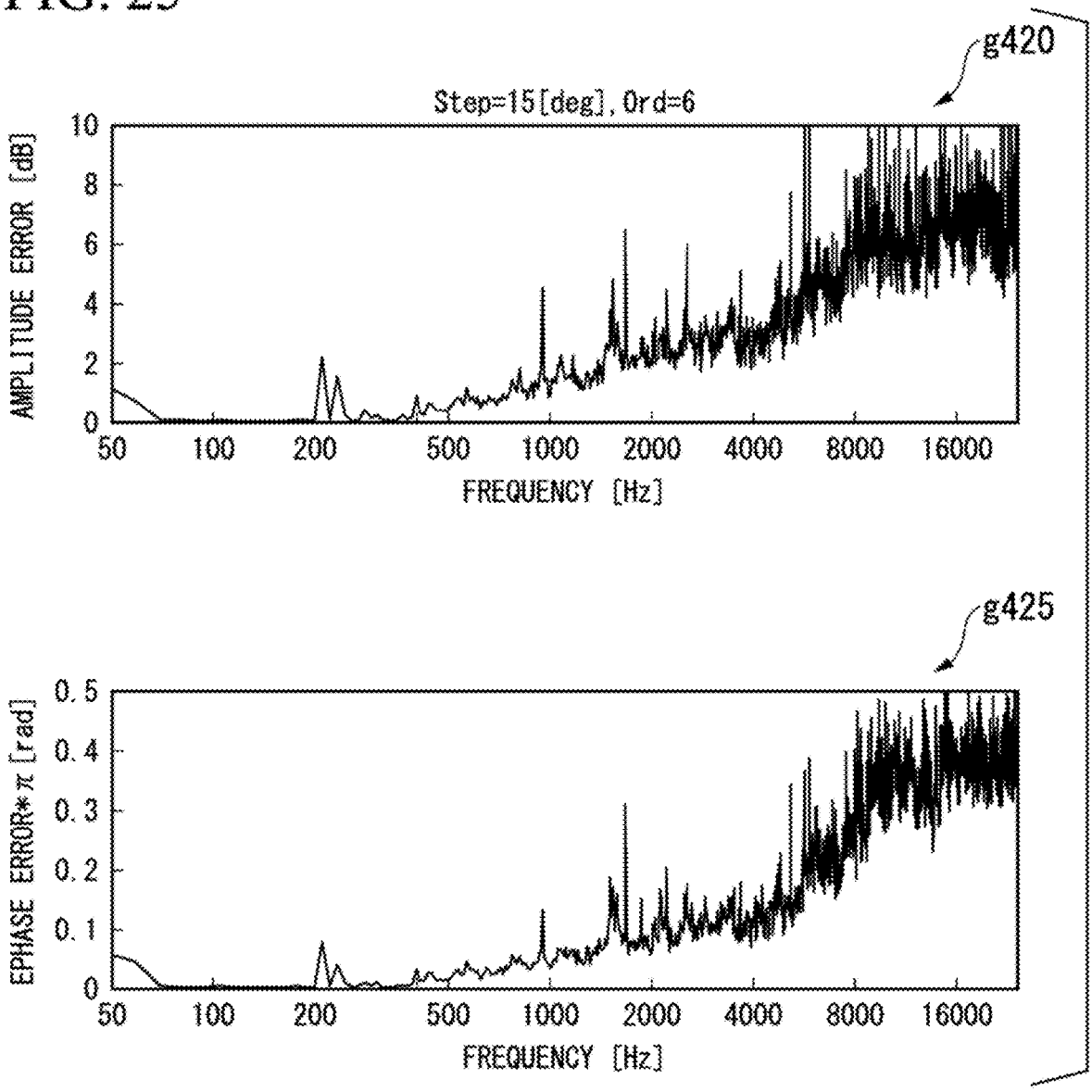
FIG. 25 is a view showing an amplitude error and a phase error with respect to a frequency in a case where an angle interval of a transfer function is 15 degrees.

FIG. 25 is a view showing an amplitude error and a phase error with respect to a frequency in a case where the angle interval of the transfer function is 15 degrees. The order of modeling is 6.

In FIG. 25, a graph g420 shows an amplitude error with respect to a frequency, and a graph g425 shows a phase error with respect to a frequency.

In the graph g420, the horizontal axis represents a frequency (Hz), and the vertical axis represents an amplitude error (dB). In the graph g425, the horizontal axis represents a frequency (Hz), and the vertical axis represents a phase error (×π rad).

Figure 26:
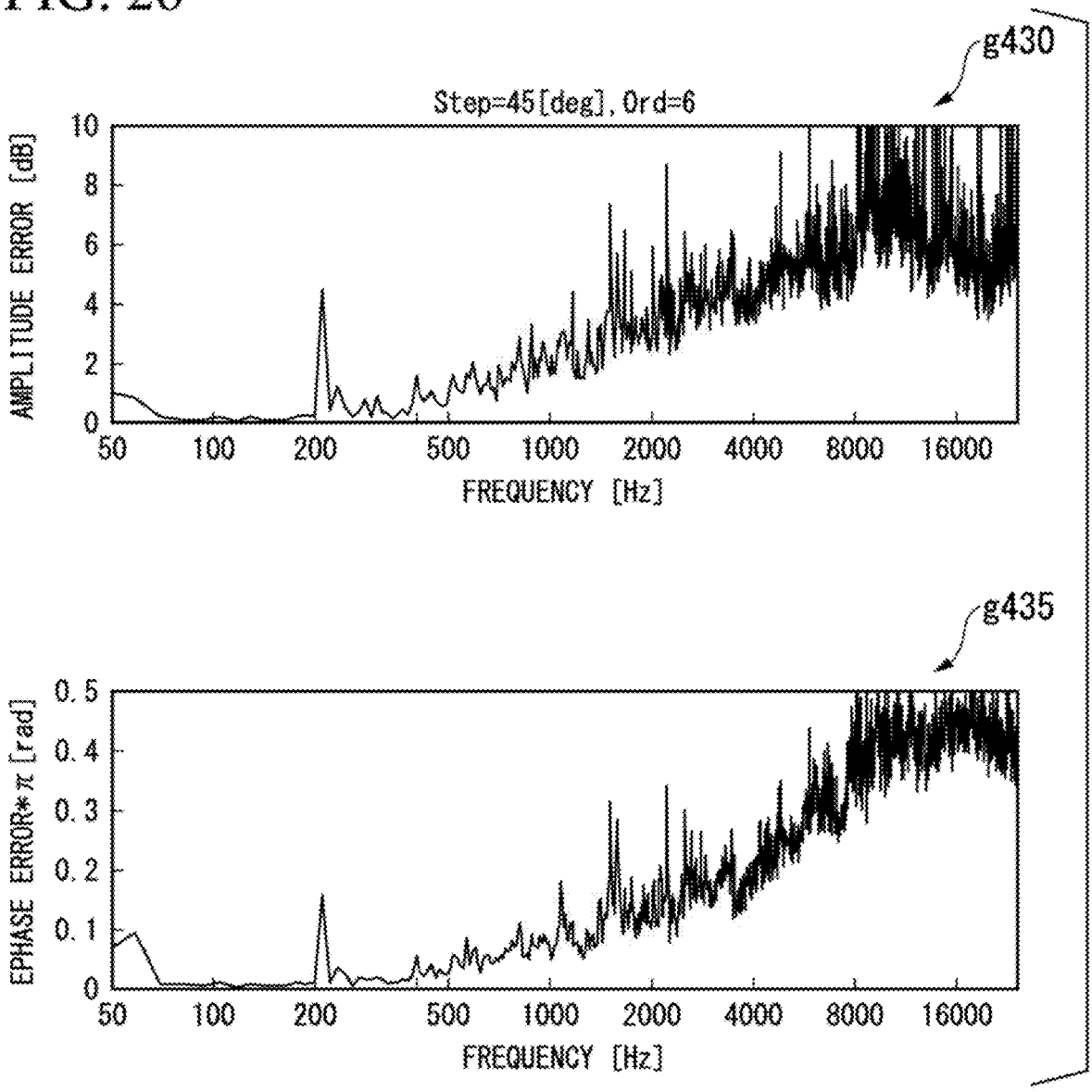
FIG. 26 is a view showing an amplitude error and a phase error with respect to a frequency in a case where an angle interval of a transfer function is 45 degrees.

FIG. 26 is a view showing an amplitude error and a phase error with respect to a frequency in a case where the angle interval of the transfer function is 45 degrees. The order of modeling is 6.

In FIG. 26, a graph g430 shows an amplitude error with respect to a frequency, and a graph g435 shows a phase error with respect to a frequency.

In the graph g430, the horizontal axis represents a frequency (Hz), and the vertical axis represents an amplitude error (dB). In the graph g435, the horizontal axis represents a frequency (Hz), and the vertical axis represents a phase error (×π rad).

As shown in FIG. 23 to FIG. 26, as the interval (interval of arrival angles) of the transfer function becomes narrower, the frequency characteristic becomes better.

[Process Sequence of Modeling]

Next, a process sequence of modeling is described.

Figure 27:
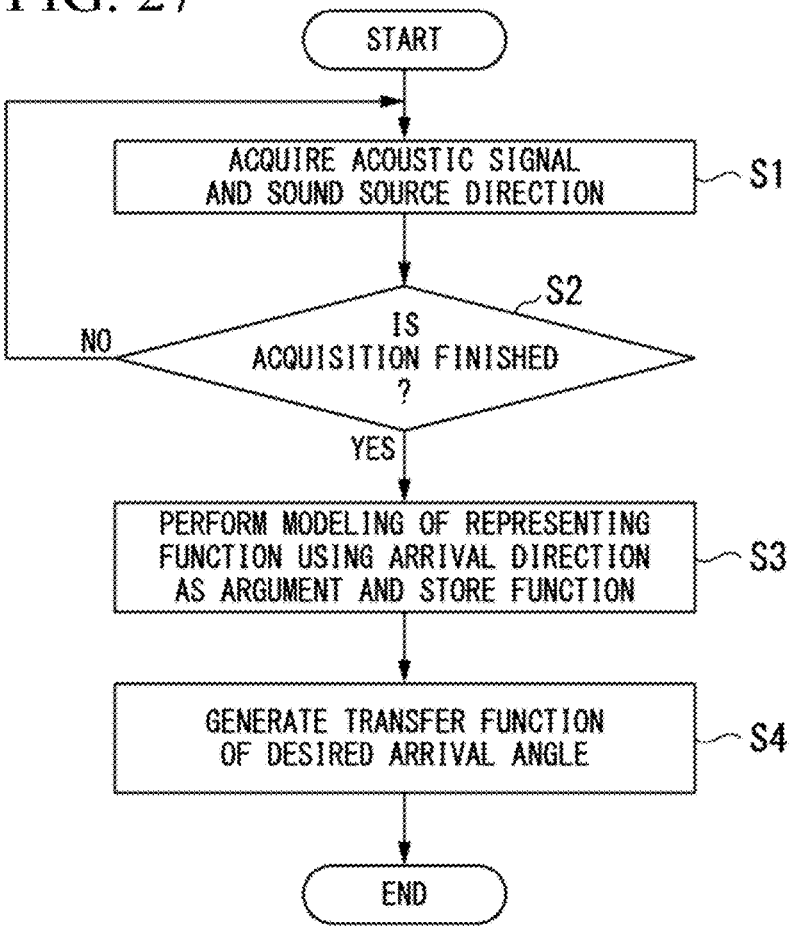
FIG. 27 is a flowchart of a process sequence of modeling according to the embodiment.

FIG. 27 is a flowchart of a process sequence of modeling according to the present embodiment. The transfer function generation apparatus 1 performs the following process for each of the microphones that are included in the sound-collecting part 12.

(Step S1) The transfer function generation apparatus 1 acquires an acoustic signal and a sound source direction for each of sound source directions. The transfer function generation apparatus 1 acquires the acoustic signal and the sound source direction, for example, at an interval of 30 degrees.

(Step S2) The transfer function generation apparatus 1 determines whether or not the acoustic signal and the sound source direction are acquired for all of the sound source directions. When it is determined that the acoustic signal and the sound source direction are acquired for all of the sound source directions (Step S2; YES), the transfer function generation apparatus 1 allows the process to proceed to Step S3. When it is determined that the acoustic signal and the sound source direction are not acquired for all of the sound source directions (Step S2; NO), the transfer function generation apparatus 1 allows the process to return to Step S1.

(Step S3) By using the acquired acoustic signal and the acquired sound source direction, the modeling part 14 performs modeling of representing a function using an arrival direction as an argument, obtains a coefficient as described above, and stores the obtained coefficient in the storage part 15.

(Step S4) The transfer function generation part 16 generates a transfer function of a desired arrival angle by using the coefficient that is stored by the storage part 15.

As described above, according to the present embodiment, by measuring a transfer function of arrival angles at an interval of 30 degrees, it is possible to generate a transfer function of an arbitrary arrival angle, that is, for example, 5 degrees or 1 degree with high accuracy. In the related art, in order to obtain the accuracy of the sound source localization and the sound source separation, measurements are performed at an equal interval such that the interval of arrival angles is, for example, 5 degrees. In the case of the interval of 5 degrees of the related art, measurements of 72 times are required in order to measure transfer functions for 360 degrees. On the other hand, in the case of the interval of 30 degrees as in the present embodiment, measurements of 12 times are sufficient.

When a transfer function is modeled, the interval of arrival angles that are measured in advance may be, for example, 15 degrees, 45 degrees, and the like. Further, the interval of arrival angles that are measured in advance may not be an equal interval. It has been already confirmed that, in a case where the interval of arrival angles that are measured in advance is not an equal interval, it is possible to generate a practical transfer function of an arbitrary arrival angle from a simulation result.

Second Modified Example

The configuration of the transfer function generation apparatus 1 is not limited to the configuration shown in FIG. 1.

Figure 28:
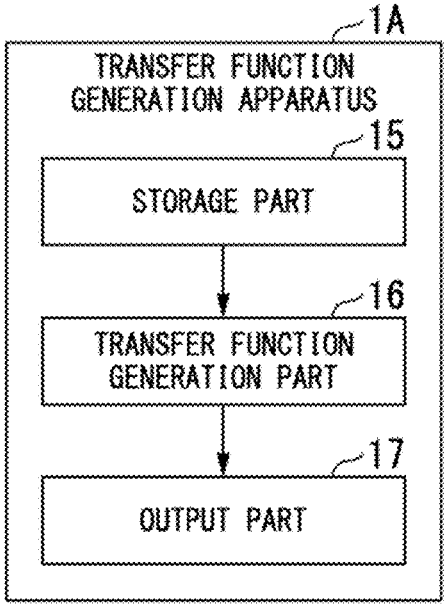
FIG. 28 is a block diagram showing a configuration example of a transfer function generation apparatus according to a second modified example.

FIG. 28 is a block diagram showing a configuration example of a transfer function generation apparatus 1A according to a second modified example.

the transfer function generation apparatus 1 includes an arrival angle acquisition part 11, As shown in FIG. 28, the transfer function generation apparatus 1A includes a storage part 15, a transfer function generation part 16, and an output part 17.

The functions and operations of the storage part 15, the transfer function generation part 16, and the output part 17 are the same as those of the transfer function generation apparatus 1.

The difference between the transfer function generation apparatus 1 and the transfer function generation apparatus 1A is that, in the transfer function generation apparatus 1A, a coefficient that is modeled and represented as a function using an arrival direction as an argument is stored in advance in the storage part 15.

In the second modified example, the modeling of the transfer function that is stored by the storage part 15 is at least one of the modeling methods of the first pattern (Expression (1) and Expression (2)), the second pattern (Expression (3) and Expression (4)), the third pattern (Expression (7)), the fourth pattern (Expression (8)), and the fifth pattern (Expression (9)) described in the embodiment.

Even in the second modified example, it is possible to obtain an advantage similar to the embodiment.

Third Modified Example

Next, an example is described in which the transfer function generation apparatus is applied to a speech recognition apparatus.

Figure 29:
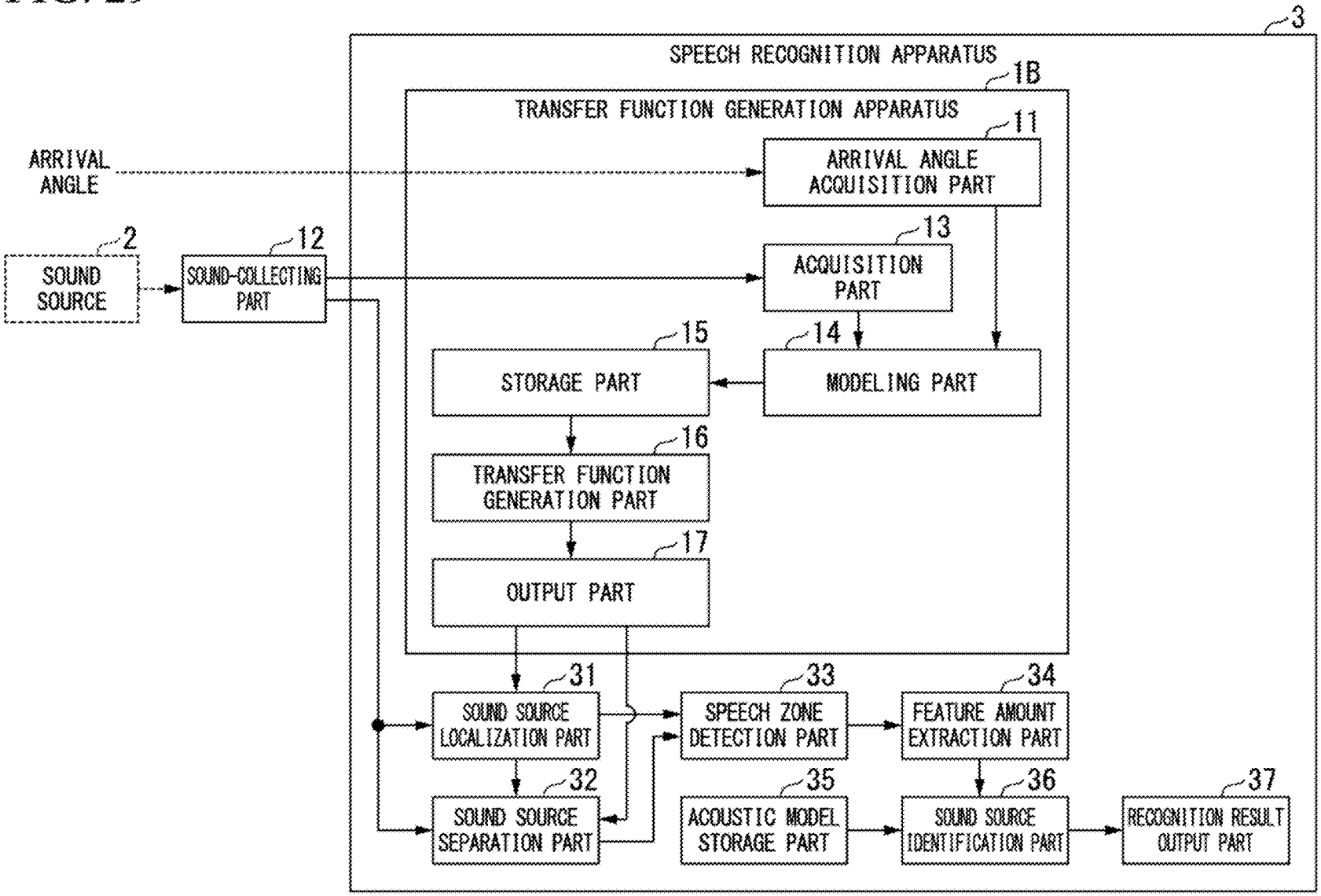
FIG. 29 is a block diagram showing a configuration example of a speech recognition apparatus according to a third modified example.

FIG. 29 is a block diagram showing a configuration example of a speech recognition apparatus 3 according to a third modified example. As shown in FIG. 29, the speech recognition apparatus 3 includes a transfer function generation apparatus 1B, a sound source localization part 31, a sound source separation part 32, a speech zone detection part 33, a feature amount extraction part 34, an acoustic model storage part 35, a sound source identification part 36, and a recognition result output part 37.

A sound-collecting part 12 as a microphone array that is formed of Q microphones is connected to the speech recognition apparatus 3. The sound-collecting part 12 outputs acoustic signals of Q channels.

Further, the transfer function generation apparatus 1B includes an arrival angle acquisition part 11, an acquisition part 13, a modeling part 14, a storage part 15, a transfer function generation part 16, and an output part 17. The same reference numeral is used for a function part that includes the same function as the transfer function generation apparatus 1, and description of the function part is omitted.

When modeling a transfer function, the transfer function generation apparatus 1B acquires an arrival angle and an acoustic signal output by the sound-collecting part 12, performs modeling of the transfer function, and stores a coefficient. The output part 17 of the transfer function generation apparatus 1B outputs the generated transfer function to the sound source localization part 31 and the sound source separation part 32.

The sound source localization part 31 determines a direction of each sound source for each frame of a predetermined length (for example, 20 ms) based on the acoustic signals of Q channels that are output by the sound-collecting part 12 (sound source localization). The sound source localization part 31 calculates a spatial spectrum indicating power in each direction using, for example, a MUSIC (Multiple Signal Classification) method in the sound source localization. The sound source localization part 31 determines a sound source direction for each sound source based on the spatial spectrum. The sound source localization part 31 outputs sound source direction information indicating a sound source direction to the sound source separation part 32 and the speech zone detection part 33. The sound source localization part 31 may calculate sound source localization by using another method, that is, for example, a weighted delay and sum beamforming (WDS-BF) method instead of the MUSIC method.

The sound source separation part 32 acquires the sound source direction information that is output by the sound source localization part 31 and the acoustic signals of Q channels that are output by the sound-collecting part 12. The sound source separation part 32 separates the acoustic signals of Q channels into a sound source-specific acoustic signal which is an acoustic signal indicating a component for each sound source based on the sound source direction that is indicated by the sound direction information. The sound source separation part 32 uses, for example, a GHDSS (Geometric-constrained High-order Decorrelation-based Source Separation) method at the time of separation into the sound source-specific acoustic signal. The sound source separation part 32 obtains a spectrum of the separated acoustic signals and outputs the obtained spectrum of the acoustic signals to the speech zone detection part 33.

The speech zone detection part 33 acquires the sound source direction information that is output by the sound source localization part 31 and the spectrum of the acoustic signals that is output by the sound source separation part 32. The speech zone detection part 33 detects a speech zone for each sound source on the basis of the spectrum of the acquired and separated acoustic signals and the sound source direction information. For example, the speech zone detection part 33 simultaneously performs sound source detection and speech zone detection by performing a threshold process on an integrated spatial spectrum that is obtained by integrating, in a frequency direction, spatial spectrums each of which is obtained for each frequency using the MUSIC method. The speech zone detection part 33 outputs a detection result, the direction information, and the spectrum of the acoustic signals to the feature amount extraction part 34.

The feature amount extraction part 34 calculates an acoustic feature amount for speech recognition from the separated spectrum that is output by the speech zone detection part 33 for each sound source. The feature amount extraction part 34 calculates an acoustic feature amount by calculating, for example, a static Mel-Scale Log Spectrum (MSLS), a delta MSLS, and one delta power for each predetermined period of time (for example, 10 ms). The MSLS is obtained by performing an inverse discrete cosine transformation on a MFCC (Mel Frequency Cepstrum Coefficient) using the spectrum feature amount, which is the feature amount of acoustic recognition. The feature amount extraction part 34 outputs the obtained acoustic feature amount to the sound source identification part 36.

The acoustic model storage part 35 stores a sound source model. The sound source model is a model that is used by the sound source identification part 36 for identifying a collected acoustic signal. The acoustic model storage part 35 stores an acoustic feature amount of the acoustic signal to be identified as the sound source model in association with information indicating a sound source name for each sound source.

The sound source identification part 36 performs sound source identification of the acoustic feature amount that is output by the feature amount extraction part 34 with reference to an acoustic model that is stored by the acoustic model storage part 35. The sound source identification part 36 outputs an identification result to the recognition result output part 37.

The recognition result output part 37 is, for example, an image display part and displays an identification result that is output by the sound source identification part 36.

(MUSIC Method)

A MUSIC method, which is one of sound source localization methods, is described.

The MUSIC method is a method of determining, as a localized sound source direction, a direction $\varphi$ at which power $P_{ext}(\varphi)$ of a spatial spectrum described below is locally maximum and is higher than a predetermined level. The sound source localization part 31 acquires a transfer function from the transfer function generation apparatus 1B.

When using the MUSIC method, the sound source localization part 31 generates a transfer function vector $[D(\varphi)]$ having transfer functions $D[q](\omega)$ from the sound source 2 to a microphone corresponding to each of channels q (q is an integer equal to or greater than 1 and equal to or less than Q) as elements for each direction $\varphi$. The sound source localization part 31 converts an acoustic signal $\xi q$ of each channel q to a frequency domain for each frame having a predetermined number of elements and thereby calculates a conversion coefficient $\xi q(\omega)$. The sound source localization part 31 calculates an input correlation matrix $[R_{\xi\xi}]$ from an input vector $[\xi(\omega)]$ that includes the calculated conversion coefficient as an element. The sound source localization part 31 calculates an eigenvalue $\delta_p$ and an eigenvector $[\varepsilon_p]$ of the input correlation matrix $[R_{\xi\xi}]$. The sound source localization part 31 calculates a power $P_{sp}(\varphi)$ of a frequency-specific spatial spectrum on the basis of the transfer function vector $[D(\varphi)]$ and the calculated eigenvector $[\varepsilon_p]$.

(GHDSS Method)

Next, the GHDSS method, which is one of sound source separation methods, is described.

The GHDSS method is a method which adaptively calculates a separation matrix $[V(\omega)]$ such that each of separation sharpness $J_{SS}([V(\omega)])$ and geometric constraint $J_{GC}([V(\omega)])$ as two cost functions is reduced. The sound source separation part 32 calculates the separation matrix on the basis of the transfer function according to the sound source direction.

The separation matrix $[V(\omega)]$ is a matrix that is used for calculating the sound source-specific acoustic signal (estimation value vector) $[u'(\omega)]$ of each of detected maximally $D_m$ sound sources by multiplying acoustic signals [(ω)] of Q channels that are input from the sound source localization part 31 by the separation matrix.

The separation sharpness $J_{SS}([V(\omega)])$ is an index value that represents the amplitude of a channel-to-channel off-diagonal component of the spectrum of the sound source-specific acoustic signal (estimation value), that is, a degree by which one sound source is erroneously separated as another sound source. The geometric constraint $J_{GC}([V(\omega)])$ is an index value that represents the degree of an error between the spectrum of the sound source-specific acoustic signal (estimation value) and the spectrum of the sound source-specific acoustic signal (sound source).

As described in the above embodiment and the above modified examples, the transfer function generation apparatus 1 (or 1A, 1B) models, using a function which uses an arrival direction of a sound source as a non-discrete argument, and stores in the storage part 15, a plurality of acoustic transfer functions to one microphone or a plurality of microphones from sound sources present in a plurality of directions. In the modeling using the function having a non-discrete argument, the method used is not limited to the Fourier series expansion, and another method such as Taylor expansion or spline interpolation may be used.

The above embodiment and the above modified examples are described using a case of using a transfer function in which the arrival directions are equally spaced; however, the embodiment is not limited thereto. It is confirmed that even in a case where the data is not equally-spaced data having the same number such as a case where there is missing data, it is possible to formulate a model. Therefore, the data obtained by the measurement may not be equally-spaced data having the same number.

Some or all of the processes performed by the transfer function generation apparatus 1 (or 1A, 1B) may be performed by recording a program realizing some or all of the functions of the transfer function generation apparatus 1 (or 1A, 1B) according to the present invention on a computer-readable recording medium and causing a computer system to read and execute the program recorded on the recording medium. The "computer system" mentioned here is assumed to include an OS or hardware such as peripheral devices. The "computer system" is assumed to also include a WWW system that includes a homepage-providing environment (or a display environment). The "computer-readable recording medium" is a portable medium such as a flexible disc, a magneto-optical disc, a ROM, a CD-ROM or a storage device such as a hard disk contained in the computer system. Further, the "computer-readable recording medium" is assumed to include a medium that retains a program for a given period of time, such as a volatile memory (RAM) in a computer system serving as a server or a client when a program is transmitted via a network such as the Internet or a communication circuit such as a telephone circuit.

The program may be transmitted from a computer system that stores the program in a storage device or the like to another computer system via a transmission medium or by transmission waves in a transmission medium. Here, the "transmission medium" transmitting the program is a medium that has a function of transmitting information, such as a network (communication network) such as the Internet or a communication circuit (communication line) such as a telephone circuit. The program may be a program realizing some of the above-described functions. Further, the program may also be a program in which the above-described functions can be realized in combination with a program which has already been recorded in a computer system, that is, a so-called a differential file (differential program).

Although the embodiment of the invention is described with reference to the drawings, the invention is not limited to the above-described embodiment. A variety of modifications and substitutions can be made without departing from the scope of the invention.

The invention claimed is:

1. A transfer function generation apparatus, comprising:

a modeling part that models, using a function which uses an arrival direction of a sound source as a non-discrete argument, a plurality of acoustic transfer functions to a microphone from sound sources present in a plurality of directions and that stores the modeled function; and a transfer function generation part that generates a transfer function of an arbitrary direction by using the modeled and stored function.

2. The transfer function generation apparatus according to claim 1, wherein in the modeling of the transfer function, the modeling part uses a transfer function from the sound source to a reference microphone among a plurality of microphones as a reference transfer function, generates a transfer function that represents an amplitude ratio and a phase difference relative to the reference transfer function as a relative transfer function by dividing a transfer function to a different target microphone than the reference microphone among the plurality of microphones by the reference transfer function, and stores the relative transfer function as the modeled function.

3. The transfer function generation apparatus according to claim 1, wherein the modeling part formulates the modeling of the transfer function by Fourier series expansion of one dimension or two or more dimensions using one arrival direction or two or more arrival directions as a main argument.

4. The transfer function generation apparatus according to claim 3, wherein the modeling part obtains, as a coefficient of the modeling by the Fourier series expansion, the coefficient by which a sum of squares of a modeling error becomes minimum, and a square norm of the coefficient of the modeling becomes minimum.

5. The transfer function generation apparatus according to claim 4, wherein the modeling part obtains the coefficient of the modeling by using a Moore-Penrose pseudo-inverse matrix from transfer functions from arbitrary two or more directions.

6. The transfer function generation apparatus according to claim 1, wherein intervals of arrival angles of a plurality of acoustic transfer functions to one or more microphones from the sound sources present in the plurality of directions are not equal to each other.

7. A transfer function generation method, comprising:

by way of a modeling part, modeling, using a function which uses an arrival direction of a sound source as a non-discrete argument, a plurality of acoustic transfer functions to a microphone from sound sources present in a plurality of directions and storing the modeled function; and by way of a transfer function generation part, generating a transfer function of an arbitrary direction by using the modeled and stored function.

8. A computer-readable non-transitory recording medium which includes a program that causes a computer of a transfer function generation apparatus to execute:

modeling, using a function which uses an arrival direction of a sound source as a non-discrete argument, a plurality of acoustic transfer functions to a microphone from sound sources present in a plurality of directions and storing the modeled function; and generating a transfer function of an arbitrary direction by using the modeled and stored function.

9. The transfer function generation apparatus according to claim 2, wherein the modeling part formulates the modeling of the transfer function by Fourier series expansion of one dimension or two or more dimensions using one arrival direction or two or more arrival directions as a main argument.

10. The transfer function generation apparatus according to claim 9, wherein the modeling part obtains, as a coefficient of the modeling by the Fourier series expansion, the coefficient by which a sum of squares of a modeling error becomes minimum, and a square norm of the coefficient of the modeling becomes minimum.

11. The transfer function generation apparatus according to claim 10, wherein the modeling part obtains the coefficient of the modeling by using a Moore-Penrose pseudo-inverse matrix from transfer functions from arbitrary two or more directions.

12. The transfer function generation apparatus according to claim 2, wherein intervals of arrival angles of a plurality of acoustic transfer functions to one or more microphones from the sound sources present in the plurality of directions are not equal to each other.

13. The transfer function generation apparatus according to claim 3, wherein intervals of arrival angles of a plurality of acoustic transfer functions to one or more microphones from the sound sources present in the plurality of directions are not equal to each other.

14. The transfer function generation apparatus according to claim 4, wherein intervals of arrival angles of a plurality of acoustic transfer functions to one or more microphones from the sound sources present in the plurality of directions are not equal to each other.

15. The transfer function generation apparatus according to claim 5, wherein intervals of arrival angles of a plurality of acoustic transfer functions to one or more microphones from the sound sources present in the plurality of directions are not equal to each other.

* * * * *